US010678161B2

(12) United States Patent
Tsuru et al.

(10) Patent No.: US 10,678,161 B2
(45) Date of Patent: Jun. 9, 2020

(54) ELECTROPHOTOGRAPHIC MEMBER HAVING ELASTIC LAYER WITH ELASTIC MODULUS OF 0.5 TO 3.0 MPA AND COATING LAYER WITH ELASTIC MODULUS OF 5.0 TO 100 MPA

(71) Applicant: CANON KABUSHIKI KAISHA, Tokyo (JP)

(72) Inventors: Seiji Tsuru, Susono (JP); Noriyuki Doi, Numazu (JP); Ryo Sugiyama, Mishima (JP); Kazuaki Nagaoka, Susono (JP); Minoru Nakamura, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/525,693

(22) Filed: Jul. 30, 2019

(65) Prior Publication Data

US 2020/0041928 A1 Feb. 6, 2020

(30) Foreign Application Priority Data

Jul. 31, 2018 (JP) ..... 2018-144361

(51) Int. Cl.

| | |
|---|---|
| ***G03G 15/00*** | (2006.01) |
| ***G03G 15/08*** | (2006.01) |
| ***G03G 15/02*** | (2006.01) |

(52) U.S. Cl.

CPC ..... *G03G 15/0808* (2013.01); *G03G 15/0233* (2013.01); *G03G 15/0291* (2013.01); *G03G 15/0818* (2013.01); *G03G 2215/0617* (2013.01)

(58) Field of Classification Search

CPC ..... G03G 15/0808; G03G 15/0818; G03G 15/0291; G03G 15/0233; G03G 2215/0617; G03G 15/162; G03G 15/0812; G03G 15/1685

See application file for complete search history.

(56) References Cited

U.S. PATENT DOCUMENTS

| | | | |
|---|---|---|---|
| 7,727,134 | B2 | 6/2010 | Nakamura et al. |
| 7,797,833 | B2 | 9/2010 | Nakamura et al. |
| 7,798,948 | B2 | 9/2010 | Kawamura et al. |
| 7,799,398 | B2 | 9/2010 | Nakamura et al. |
| 8,298,670 | B2 | 10/2012 | Muranaka et al. |

(Continued)

FOREIGN PATENT DOCUMENTS

| | | |
|---|---|---|
| JP | 2001-109276 | 4/2001 |
| JP | 2007-316524 | 12/2007 |
| JP | 2017-156745 | 9/2017 |

OTHER PUBLICATIONS

U.S. Appl. No. 16/516,790, Kazutoshi Ishida, filed Jul. 19, 2019.

(Continued)

*Primary Examiner* — Susan S Lee

(74) *Attorney, Agent, or Firm* — Venable LLP

(57) ABSTRACT

An electrophotographic member has an electro-conductive substrate, an elastic layer on the substrate and a coating layer on the elastic layer. The elastic layer has an elastic modulus of 0.5 MPa to 3.0 MPa and the coating layer has an elastic modulus of 5.0 MPa to 100.0 MPa as measured in an environment of a temperature of 30° C. and a relative humidity of 80%.

16 Claims, 7 Drawing Sheets

(56) References Cited

U.S. PATENT DOCUMENTS

| | | | |
|---|---|---|---|
| 8,449,975 | B2 | 5/2013 | Hirakoso et al. |
| 8,655,222 | B2 | 2/2014 | Nakamura et al. |
| 8,655,238 | B2 | 2/2014 | Uno et al. |
| 8,745,870 | B2 | 6/2014 | Kawamura et al. |
| 8,768,227 | B2 | 7/2014 | Urushihara et al. |
| 8,798,508 | B2 | 8/2014 | Yamada et al. |
| 8,874,007 | B2 | 10/2014 | Kawamura et al. |
| 9,023,465 | B2 | 5/2015 | Yamada et al. |
| 9,556,359 | B2 | 1/2017 | Suzumura et al. |
| 9,625,854 | B2 | 4/2017 | Koyanagi et al. |
| 9,811,021 | B2 | 11/2017 | Muranaka et al. |
| 9,846,407 | B2 | 12/2017 | Nakamura et al. |
| 9,921,513 | B2 | 3/2018 | Masu et al. |
| 9,921,518 | B2 | 3/2018 | Sakurai et al. |
| 9,952,531 | B2 | 4/2018 | Ishii et al. |
| 9,952,532 | B2 | 4/2018 | Sugiyama et al. |
| 9,989,879 | B2 | 6/2018 | Doi et al. |
| 10,036,971 | B2 | 7/2018 | Doi et al. |
| 10,078,286 | B2 | 9/2018 | Takeno et al. |
| 10,310,447 | B2 | 6/2019 | Morishita et al. |
| 10,365,576 | B2 | 7/2019 | Doi et al. |
| 10,459,356 | B2 | 10/2019 | Takeno et al. |
| 2012/0251171 | A1 | 10/2012 | Muranaka et al. |
| 2012/0308261 | A1 | 12/2012 | Tsuru et al. |
| 2013/0130022 | A1 | 5/2013 | Uesugi et al. |
| 2013/0164038 | A1 | 6/2013 | Kusaba et al. |
| 2013/0266339 | A1 | 10/2013 | Sugiyama et al. |
| 2014/0072343 | A1 | 3/2014 | Masu et al. |
| 2014/0080691 | A1 | 3/2014 | Kurachi et al. |
| 2014/0334843 | A1 | 11/2014 | Taniguchi et al. |
| 2017/0102633 | A1* | 4/2017 | Yoshidome ..... G03G 15/0233 |
| 2017/0139336 | A1 | 5/2017 | Nagaoka et al. |
| 2017/0248867 | A1 | 8/2017 | Sakurai et al. |
| 2019/0265609 | A1 | 8/2019 | Sakurai et al. |

OTHER PUBLICATIONS

U.S. Appl. No. 16/524,794, Shohei Urushihara, filed Jul. 29, 2019.
U.S. Appl. No. 16/526,125, Sosuke Yamaguchi, filed Jul. 30, 2019.
U.S. Appl. No. 16/540,463, Noriyuki Doi, filed Aug. 14, 2019.
U.S. Appl. No. 16/541,732, Kazuhito Wakabayashi, filed Aug. 15, 2019.
U.S. Appl. No. 16/545,434, Kenta Matsunaga, filed Aug. 20, 2019.
U.S. Appl. No. 16/569,768, Fumihiko Utsuno, filed Sep. 13, 2019.
U.S. Appl. No. 16/672,770, Wataru Moriai, filed Nov. 4, 2019.

* cited by examiner

ELECTROPHOTOGRAPHIC MEMBER HAVING ELASTIC LAYER WITH ELASTIC MODULUS OF 0.5 TO 3.0 MPA AND COATING LAYER WITH ELASTIC MODULUS OF 5.0 TO 100 MPA

BACKGROUND OF THE INVENTION

Field of the Invention

The present invention relates to an electrophotographic member, an electrophotographic process cartridge and an electrophotographic image forming apparatus.

Description of the Related Art

An electrophotographic member to be used in an electrophotographic apparatus is required to have, for example, a function of stably conveying a toner. In order to obtain an elastic electrophotographic member having enhanced durability upon use, there has been a proposal of providing the surface of the electrophotographic member with a surface layer for enhancing the durability of the member. Further, in order to obtain an electrophotographic member having improved toner conveying force, an electrophotographic member equipped with a dielectric part having a high electrical resistance on the surface of its conductive part and therefore capable of conveying a toner electrically adsorbed to the charged dielectric part has been developed. Japanese Patent Application Laid-Open No. 2017-156745 discloses an example of an electrophotographic member suited for use in a method of forming an electrophotographic image by using a nonmagnetic one-component toner. More specifically, it discloses an electrophotographic member capable of supporting a large amount of a nonmagnetic one-component toner by making use of many micro closed electric fields (microfields) formed in the vicinity of the surface.

SUMMARY OF THE INVENTION

One aspect of the invention is directed to provision of an electrophotographic member capable of preventing a reduction in image density even if used for a long period of time in a high-temperature and high-humidity severe environment.

Another aspect of the invention is directed to provision of a process cartridge useful for the formation of a high-quality electrophotographic image in various environments.

A further aspect of the invention is directed to provision of an electrophotographic image forming apparatus capable of forming a high-quality electrophotographic image even in various environments.

According to the one aspect disclosed herein, there is provided an electrophotographic member having an electroconductive substrate, an elastic layer on the substrate and a coating layer on the elastic layer, wherein:

the elastic layer has, on a surface thereof on a side opposite to a side facing the substrate, a first protrusion, the electrophotographic member has, on an outer surface thereof, a second protrusion derived from the first protrusion, the outer surface of the electrophotographic member has one or more of electrical insulating first region(s) and an electro-conductive second region, the elastic layer has an elastic modulus, as measured in an environment of a temperature of 30° C. and a relative humidity of 80%, of 0.5 MPa or more to 3.0 MPa or less, and the coating layer has an elastic modulus, as measured in the environment, of 5.0 MPa or more to 100.0 MPa or less.

According to the another aspect disclosed herein, there is provided an electrophotographic process cartridge mounted detachably on an electrophotographic image forming apparatus and having at least the above-described electrophotographic member.

According to the further aspect disclosed herein, there is provided an electrophotographic image forming apparatus having at least the above-described electrophotographic member.

Further features of the present invention will become apparent from the following description of exemplary embodiments with reference to the attached drawings.

DESCRIPTION OF THE EMBODIMENTS

Figure 1A:
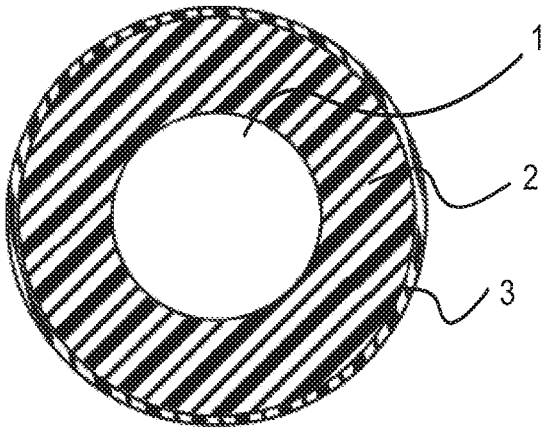
FIG. 1A is a cross-sectional view showing one example of the electrophotographic member relating to the present disclosure.

According to the investigation by the present inventors, the electrophotographic member of Japanese Patent Application Laid-Open No. 2017-156745, for example when used for a long period of time in a high-temperature and high-humidity environment, sometimes caused a reduction in the density of an electrophotographic image formed. The present inventors presume that it occurred because of the following reason.

The electrophotographic member according to Japanese Patent Application Laid-Open No. 2017-156745 has, on the outer surface thereof, an electrical insulating domain for forming a micro closed electric field. When this electrophotographic member is used for a long period of time in a high-temperature and high-humidity environment, the domain is expanded and contracted in repetition during use for a long period of time in a high-temperature and high-humidity environment and as a result, it has minute cracks. From these cracks, water enters into the domain. The resulting water reduces the electrical resistivity of the domain and weakens a micro closed electric field formed between the domain and an exposed portion of an electro-conductive elastic layer, leading to a decrease in a conveying amount of a toner. This is presumed to cause a reduction in the density of an electrophotographic image.

The present inventors have proceeded with investigations based on such a consideration. As a result, they have found that an electrophotographic member having the following constitution does not easily cause a deterioration in the intensity of a micro closed electric field even used in a high-temperature and high-humidity environment and can therefore stably form a high-quality electrophotographic image.

The electrophotographic member according to the present disclosure has an electro-conductive substrate, an elastic layer on the substrate and a coating layer on the elastic layer.

The elastic layer has, on a surface thereof on a side opposite to a side facing the substrate, a first protrusion and the electrophotographic member has, on an outer surface thereof, a second protrusion derived from the first protrusion.

The outer surface of the electrophotographic member is constituted of an electrical insulating first region and an electro-conductive second region.

The elastic layer has an elastic modulus, as measured in an environment of a temperature of 30° C. and a relative humidity of 80%, of 0.5 MPa or more to 3.0 MPa or less.

The coating layer has an elastic modulus, as measured in an environment of a temperature of 30° C. and a relative humidity of 80%, of 5.0 MPa or more to 100.0 MPa or less.

The electrophotographic member according to the present disclosure will hereinafter be described in detail.

[Electrophotographic Member]

In the present disclosure, the term "electrophotographic member" means a member such as developer carrier, transfer member, charging member, cleaning blade or developer layer thickness regulating member. Specific examples include conductive rollers such as developing roller, transfer roller and charging roller, a cleaning blade and a developing blade.

The electrophotographic member according to the present disclosure will hereinafter be described if necessary by using a developing roller which is a typical example, but the present disclosure is not limited to or by it.

Figure 1B:
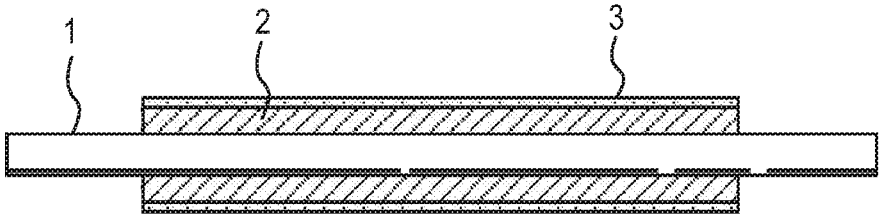
FIG. 1B is a cross-sectional view showing one example of the electrophotographic member relating to the present disclosure.

The schematic cross-sections of the electrophotographic member according to the present disclosure are shown in FIGS. 1A and 1B, respectively.

The electrophotographic member has an electro-conductive substrate 1, an elastic layer 2 on the electro-conductive substrate and a coating layer 3 on the elastic layer 2.

Figure 2:
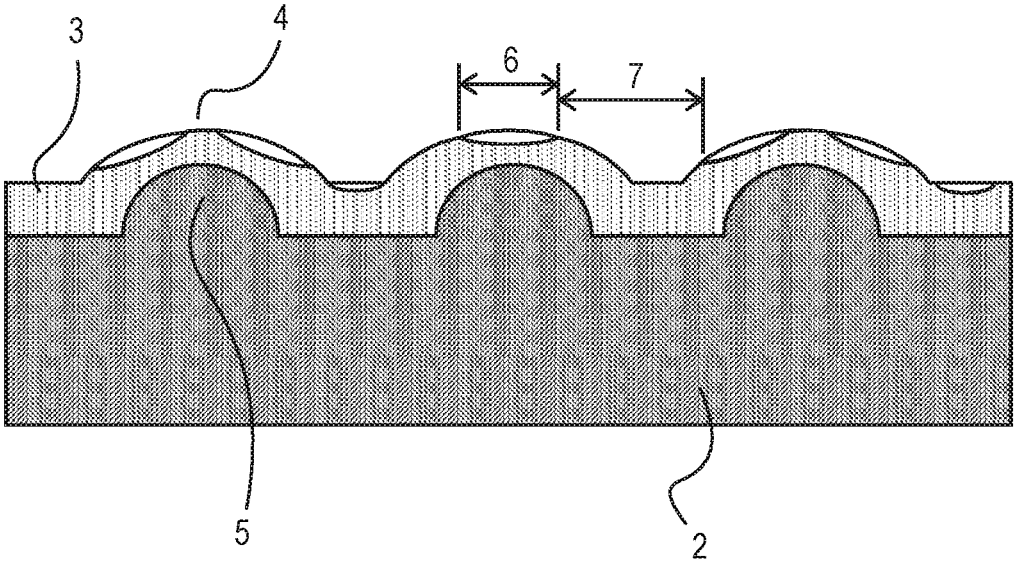
FIG. 2 is a cross-sectional view showing one example of the vicinity of the surface of the electrophotographic member relating to the present disclosure.

The schematic cross-section of the electrophotographic member in the vicinity of the surface thereof is shown in FIG. 2.

The elastic layer 2 has, on a surface thereof on a side opposite to a side facing the substrate, a first protrusion 5 and the electrophotographic member has, on an outer surface thereof, a second protrusion 4 derived from the first protrusion 5.

The outer surface of the electrophotographic member is constituted of an electrical insulating first region 6 and an electro-conductive second region 7; the elastic layer 2 has an elastic modulus, as measured in an environment of a temperature of 30° C. and a relative humidity of 80%, of 0.5 MPa or more to 3.0 MPa or less; and the coating layer 3 has an elastic modulus, as measured in the environment, of 5.0 MPa or more to 100.0 MPa or less.

The outer surface of the electrophotographic member is constituted of the electrical insulating first region and the electro-conductive second region and these two regions form, at a boundary therebetween, a micro closed electric field to stably convey a toner.

When the electrophotographic member is included in an electrophotographic image forming apparatus, the outer surface of the electrophotographic member is used while carrying a toner thereon and being slid and rubbed in contact with a photoreceptor or developer regulating member. In order that the outer surface of the electrophotographic member carries a toner and brings it into contact with the photoreceptor or developer regulating member with uniform force, the elastic layer 2 is made of a soft elastic body. Since the electrophotographic member is slid and rubbed in repetition in contact with the photoreceptor or developer regulating member, the elastic layer has, on the surface thereof, the coating layer 3 made of a material stronger against sliding and rubbing than the elastic body of the elastic layer to prevent the elastic layer from being broken by a sliding and rubbing stress.

The outer surface of the electrophotographic member subjected to the sliding and rubbing stress caused by the repeated passage of a contact part is pulled in repetition in its rotating circumferential direction to be expanded and contracted. By repeated expansion and contraction of the outer surface, the insulating first region also expands and contracts in repetition.

The developing roller according to Japanese Patent Application Laid-Open No. 2017-156745 does not have a protrusion 5 on the surface of an elastic layer. In this case, an insulating first region expands and contracts in substantial proportion to the expansion and contraction of the outer surface. When the elastic layer does not have such a protrusion 5, the insulating region is expanded and contracted repeatedly by the use for a long period of time in a high-temperature and high-humidity environment. Minute cracks as described above are therefore presumed to be formed.

On the other hand, the electrophotographic member according to the present disclosure has, on the surface of the elastic layer thereof, the first protrusion 5 and has, on the outer surface of the electrophotographic member, the second protrusion 4 derived from the first protrusion 5. The coating layer 3 therefore has, outside thereof, protruding portions. When the coating layer as the outer surface of the electrophotographic member is pulled, an arch of the coating layer formed by the first protrusion and the second protrusion is flattened and a curved surface length of the outer surface of the electrophotographic member shows almost no expansion. Since the curved surface length of the outer surface does not show expansion, expansion of the curved surface length of the electrical insulating first region decreases. In addition, a portion of the expansion of the coating layer is absorbed because the second protrusion becomes more flat, and thus an expansion amount of the coating layer in a portion other than the second protrusion becomes smaller compared with the case where the electrophotographic member does not have the second protrusion.

As a result, expansion of the curved surface length of the surface of both the coating layer of the second protrusion and the other portion of the coating layer is suppressed. Suppression of the expansion of the curved surface length of the surface of the coating layer leads to suppression of the expansion of the curved surface length of the electrical insulating first region, which is a portion of the surface of the coating layer, prevention of minute cracks from appearing in the insulating region, a reduction in the amount of water entering into the insulating region and suppression of a reduction in electrical resistivity. Even if an endurance test is performed under severe conditions, therefore, a reduction in the electrical resistivity of the electrical insulating first region is suppressed so that such a constitution is effective for maintaining the intensity of the micro closed electric field and preventing deterioration in conveyance of a toner.

It can be confirmed by the observation of the cross-section of the electrophotographic member under an optical microscope or electron microscope that the second protrusion is derived from the first protrusion. Described specifically, from an image obtained by microscopic observation of the electrophotographic member at a cross-section perpendicular to the axial direction thereof, an interface profile between the elastic layer and the coating layer and a surface profile of the electrophotographic member are extracted. Then, it can be found based on the correlation of the profile curve between them.

<Conductive Substrate>

The electro-conductive substrate has conductivity and has a function of supporting an electro-conductive layer to be provided thereon. Examples of the material of it include metals such as iron, copper, aluminum and nickel, alloys containing any of these metals such as stainless steel, duralumin, brass and bronze and synthetic resins having conductivity. The surface of the substrate may be plated without damaging its conductivity. Further, as the electro-conductive substrate, that having a surface made conductive by coating a base material made of a resin with a metal or that made of an electro-conductive resin composition is also usable. The surface of the electro-conductive substrate may be coated with a primer for improving adhesion between the electro-conductive substrate and the elastic layer. Examples of the primer include silane coupling agent-based primers and urethane-based, acrylic, polyester-based, polyether-based or epoxy-based thermosetting resins and thermoplastic resins.

<Elastic Layer>

Existence of the elastic layer enables uniform contact of the electrophotographic member with another member.

The elastic layer has an elastic modulus, as measured in an environment of a temperature of 30° C. and a relative humidity of 80%, of 0.5 MPa or more to 3.0 MPa or less. Adjustment of the elastic modulus to fall within the above-described range makes it possible to make the deformation of the electrophotographic member more appropriate at a contact part with another member and suppress deterioration in insulating properties of the electrical insulating first region even if the member is used for a long period of time under more severe conditions.

It also makes it possible to certainly relax a local contact pressure and suppress deterioration of a toner. The elastic modulus of the elastic layer can be determined by measuring a smooth cross-section of the elastic layer by a Martens hardness tester.

As a material for the elastic layer, various rubber materials can be used. Examples of the rubber used for the rubber materials include ethylene-propylene-diene copolymer rubbers (EPDM), acrylonitrile-butadiene rubbers (NBR), chloroprene rubbers (CR), natural rubbers (NR), isoprene rubbers (IR), styrene-butadiene rubbers (SBR), fluororubbers, silicone rubbers, epichlorohydrin rubbers and urethane rubbers. These rubbers may be used either singly or in combination of two or more thereof. Of these, silicone rubbers are preferred. Examples of the silicone rubbers include polydimethylsiloxane, polymethyltrifluoropropylsiloxane, polymethylvinylsiloxane, polyphenylvinylsiloxane and copolymers of these siloxanes.

The elastic layer is obtained by adding various additives such as conductivity imparting agent, non-conductive filler and catalyst as needed. As the conductivity imparting agent, usable are particles of an electro-conductive metal such as aluminum and copper, particles of an electro-conductive metal oxide such as zinc oxide, tin oxide or titanium oxide, carbon black and the like. Of these, carbon black which is relatively easily available and capable of providing good conductivity is preferred. When carbon black is used as the conductivity imparting agent, it is preferred to mix from 5 to 40 parts by mass of carbon black with 100 parts by mass of the rubber in the rubber material. Examples of the non-conductive filler include silica, quartz powder, titanium oxide, zinc oxide and calcium carbonate. The electrical resistivity of the elastic layer can be determined by cutting the elastic layer into a thin section having surfaces parallel to each other, sandwiching it with two electrodes having a known area and calculating the resistivity from a voltage applied to the electrodes, an electric current flowing therebetween, the thickness of the thin section and the area of the electrodes.

The thickness of the elastic layer preferably falls within a range of from 0.5 mm to 5.0 mm, with a range of from 2.0 mm to 4.0 mm being more preferred. The elastic layer is only required to be provided on the electro-conductive substrate and it is not required to cover the entire surface of the electro-conductive substrate.

The elastic layer has, on the outer surface thereof, the first protrusion. This first protrusion, together with the second protrusion derived from the first protrusion, absorbs the expansion of the surface curved length of the electrophotographic member due to expansion and contraction of the coating layer, suppresses a reduction in the volume resistivity of the electrical insulating first region on the surface of the electrophotographic member and thereby keeps the toner conveyance of the electrophotographic member.

As a method of providing an elastic layer on the electro-conductive substrate, a known method can be used. Examples include an extrusion method in which respective materials for forming the substrate and the elastic layer are extruded and an extruding polishing method in which the materials are extruded and then polished. When the materials are in liquid form, examples include an in-mold molding method in which the materials are poured in a cylindrical pipe and a mold provided at both ends of the pipe and having an insert piece for supporting the substrate therewith and then, cured by heating or the like.

Examples of a method of providing a first protrusion on the outer surface of the elastic layer include a method of providing a protrusion by surface polishing or grinding in the extruding polishing method, a method of preliminarily mixing elastic particles with the materials at the time of extrusion and a method of transferring surface irregularities after extrusion but before curing. Further, molding method in which preliminary forming a recess in the inner surface of the mold for molding, molding with the mold to transfer the recess in the inner surface of the mold to obtain a protrusion, may also be used. As a method of providing a first protrusion, the method of transferring the inner surface of the mold by molding is particularly preferred because it can form the shape of the surface of the elastic layer precisely.

For providing a recess in the inner surface of the mold in the in-mold molding, various known methods can be used. Examples of such a method include a sand blasting method, a method of pressing a hard protrusion against the inner surface, a cutting method, a method of intensively exposing the inner surface to laser to provide a recess and a method of plating the inner surface together with particles which will become a recess. The size or density of the recess in the inner surface of the mold is adjusted depending on the size or density of an intended protrusion.

The first protrusion can be checked by observing the cross-section of the electrophotographic member by an optical microscope or an electron microscope. Described specifically, from an image obtained by microscopic observation of the elastic layer and the coating layer of the electrophotographic member at a cross-section perpendicular to an axial direction of the electrophotographic member, an interface between the elastic layer and the coating layer is detected and then, the size or distribution of the protrusion can be found from the curve of the interface.

With respect to the size of the first protrusion, its height is preferably from 2.0 μm to 50.0 μm, more preferably from 3.0 μm to 15.0 μm. The width of the first protrusion is preferably from 5.0 μm to 300.0 μm, more preferably from 15.0 μm to 60.0 μm.

The first protrusion having a size within the above-described range is preferred because the second protrusion having an appropriate size can be formed at the time of forming the coating layer and the electrophotographic member can therefore have an appropriate surface roughness, making it possible to achieve an effect of causing sufficient sliding and rubbing of a toner at the contact part with a regulating member and charging the toner uniformly.

The number density of the first protrusion is preferably set so that the sum of the widths of the respective protrusions becomes from 3% to 90% of a base line distance of the interface between the elastic layer and the coating layer at the cross-section. When the number density falls within the above-described range, an effect of suppressing expansion and contraction of the electrical insulating first region can be achieved. The distribution of the protrusion is preferably uniform.

<Coating Layer>

The coating layer has an elastic modulus, as measured in an environment of a temperature of 30° C. and a relative humidity of 80%, of 5.0 MPa or more to 100.0 MPa or less. The material of the coating layer capable of satisfying both the above-described elastic modulus and conductivity is preferably a material obtained by mixing a conducting agent with a resin binder. The elastic modulus of the coating layer can be determined by measuring a smooth cross-section of the coating layer by a Martens hardness tester. As the resin binder constituting the coating layer, resins such as urethane resin, fluoroplastic, silicone resin, acrylic resin, polyamide resin, polyester resin, urea resin, melamine resin and phenolic resin are preferably used.

As the conducting agent used for the coating layer, an electron conducting agent or an ion conducting agent can be used. Since the coating layer is positioned near a photoreceptor, use of the electron conducting agent is particularly preferred. As the electron conducting agent or ion conducting agent, the above-described various conducting agents can be used.

The electro-conductive part of the coating layer exposed directly from the surface of the electrophotographic member becomes an electro-conductive second region. The coating layer has a volume resistivity of preferably from $1\times10^5$ to $1\times10^{11}$ Ω·cm.

The electro-conductive second region having a resistivity within the above-described range can more certainly prevent leakage of a charge from the contact part with the photoreceptor or regulating member. This makes it possible to apply a sufficient voltage to the electrophotographic member and therefore a sufficient charge can be given to a toner. In addition, since a strong micro closed electric field is formed between the electrical insulating first region and the electro-conductive second region and toner conveyance is excellent, deterioration in development density can be suppressed.

The volume resistivity of the coating layer can be determined, for example, by cutting the coating layer into a thin section having surfaces parallel to each other with a cryo-microtome, sandwiching it with two electrodes having a known area and calculating the volume resistivity from a voltage applied to the electrodes, an electric current flowing therebetween, the thickness of the thin section and the area of the electrodes.

The coating layer can also contain an ingredient such as leveling agent, roughening particles, dielectric, lubricant, adsorbent and dispersing agent if necessary. The roughening agent is added to adjust the surface roughness of the coating layer.

The coating layer is formed by dispersing the above-described materials constituting the coating layer by a known method in a conventionally known dispersing apparatus making use of beads such as a sand mill, a paint shaker, a DYNO-MILL or a pearl mill. The resulting resin coating material for forming the coating layer is applied onto the elastic layer by dipping, spray coating, roll coating or ring coating.

The coating layer has a film thickness of preferably from 1.0 to 50.0 μm, more preferably from 3.0 to 30.0 μm. The coating layer having a film thickness within the above-described range is preferred because it can achieve an effect of maintaining the flexibility of the electrophotographic member, providing an appropriate hardness and suppressing fusion of a toner and the like to the surface of the photoreceptor or surface of the electrophotographic member. In addition, the coating layer having a film thickness within the above-described range can achieve an effect of protecting the elastic layer from sliding and rubbing by another member. The film thickness of the coating layer can be measured, as well as that of the protrusion of the elastic layer, by observing the cross-section of the electrophotographic member under an optical microscope or electron microscope.

To adjust the film thickness of the coating layer, a solid content of the resin of the coating-layer forming coating material and the pull-up speed upon coating are controlled. An increase in the solid content of the resin in the coating-layer forming coating material increases the film thickness of the coating layer, while a decrease in the solid content decreases the film thickness. In the coating-layer forming coating material, the solid content of the resin relative to an evaporative solvent is adjusted to from 5 to 50%. The pull-up speed upon coating is preferably set at, for example, from 20 to 5000 mm/min from the standpoint of easy film-thickness control.

The film thickness of the coating layer and the amount of the roughening particles are adjusted so as to form a second protrusion derived from the first protrusion.

Figure 3:
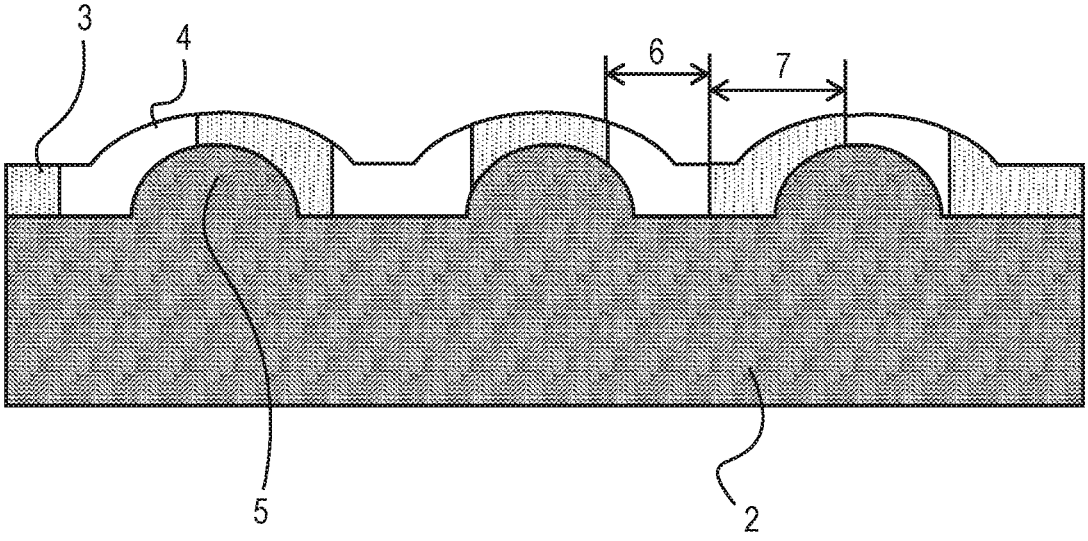
FIG. 3 is a cross-sectional view showing another example of the vicinity of the surface of the electrophotographic member relating to the present disclosure.

The coating layer itself may cause phase separation as shown in FIG. 3 and may be separated into the insulating first region 6 and the electro-conductive second region 7. Alternatively, it is preferred that as shown in FIG. 2, the first region is constituted of an electrical insulating part on the surface of the coating layer on a side opposite to a side facing the substrate. When the coating layer has such a constitution, the arch of the coating layer is flattened more uniformly so that a reduction in the electrical resistivity of the first region is suppressed. Even if an endurance test is performed under severe conditions, an effect of maintaining the intensity of the micro closed electric field can be achieved.

<Electrical Insulating First Region>

The electrophotographic member has an electrical insulating first region distributed on the outer surface thereof. The first region may be present on either the second protrusion of the outer surface of the electrophotographic member or a portion of the outer surface other than the second protrusion. It may be present much on the second protrusion or may be present much on the portion other than the second protrusion.

The first region may be provided on the surface of the coating layer or may be provided on a modified portion of the surface of the coating layer.

Figure 4:
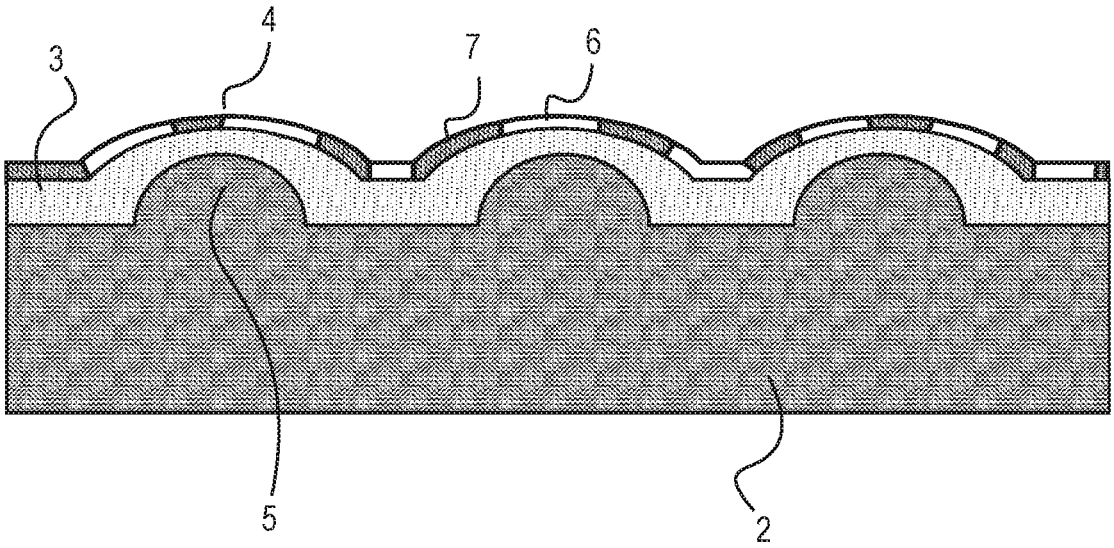
FIG. 4 is a cross-sectional view showing a further example of the vicinity of the surface of the electrophotographic member relating to the present disclosure.
Figure 5:
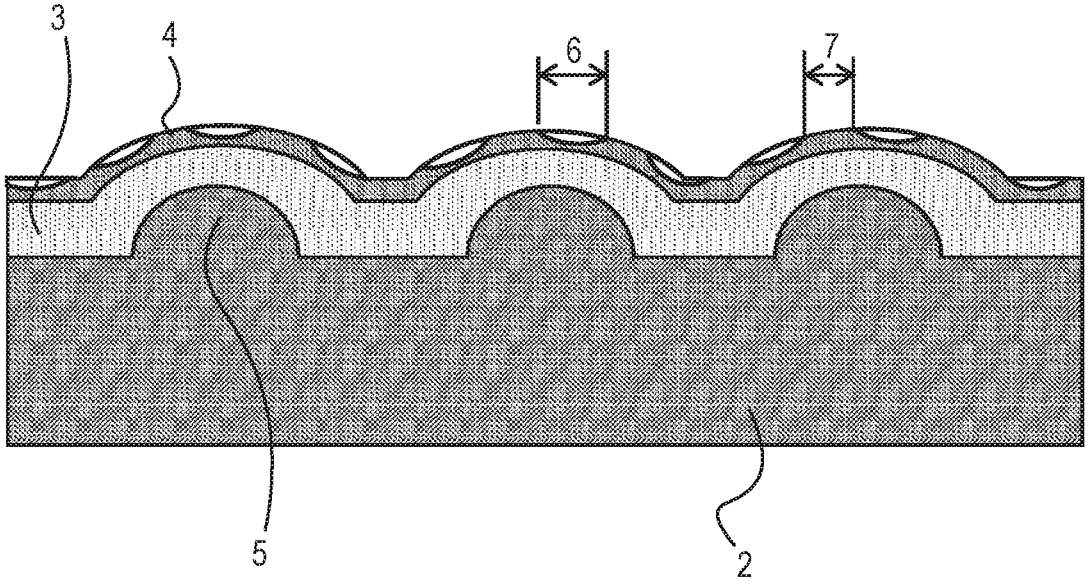
FIG. 5 is a cross-sectional view showing a still further example of the vicinity of the surface of the electrophotographic member relating to the present disclosure.

As shown in FIG. 4, after formation of a surface layer on the coating layer further, a portion of the surface layer may be formed as the insulating first region. As shown in FIG. 5, the insulating first region may be provided on the outer surface of the surface layer. In this case, when the surface layer is provided, phase separation is caused to obtain the first region. In particular, by forming a surface layer by coating and then causing phase separation of it at the time of heat drying or exposure to energy rays, the first region can be provided.

The first region may be constituted of an electrical insulating part on the surface of the coating layer on a side opposite to a side facing the substrate. In this case, a plurality of electrical insulating parts may be present independently from each other on the surface. When they are present independently from each other, a boundary line between the first region and the second region becomes long and a boundary line constituting the micro closed electric field becomes long. As a result, an effect of enhancing toner conveyance can be achieved.

The electrical insulating first region is required to have high resistance. It has preferably an electrical resistivity of from $1\times10^{13}$ to $1\times10^{18}$ Ω·cm. The first region having a resistivity within the above-described range has an intense micro closed electric field formed between the first region and the electro-conductive second region and has excellent toner conveyance. As a result, an effect of suppressing deterioration in development density can be achieved. The electrical resistivity of the first region can be determined, for example, by cutting the first region into a thin section having surfaces parallel to each other with a cryomicrotome, sandwiching it with two electrodes having a known area and calculating the resistivity from a voltage applied to the electrodes, an electric current flowing therebetween, the thickness of the thin section and the area of the electrodes.

The electrical insulating first region occupies a certain area in the entire area of the surface of the electrophotographic member. An area ratio of the insulating first region to the entire surface of the electrophotographic member is preferably from 5% to 95%, more preferably from 10% to 80%. Since a micro closed electric field appears at a boundary portion between the insulating first region and the electro-conductive second region, the boundary line between the insulating first region and the electro-conductive second region is preferably distributed uniformly on the surface of the electrophotographic member. The uniform distribution is preferred because it makes the toner conveying performance uniform at each position on the surface of the electrophotographic member and makes the resulting image density uniform. The length of the boundary line between the insulating first region and the electro-conductive second region is preferably from 2 mm/mm$^2$ to 200 mm/mm$^2$ per unit area of the surface of the electrophotographic member.

In order to obtain enhanced toner conveyance, it is preferred that the electrical insulating first region has large electrical resistance and the first region has uniform distribution. When the electrical insulating first region has large electrical resistance and the first region is distributed uniformly, damping of charges with which the first region is charged decreases. The damping of charges with which the first region is charged is preferably small because damping of the intensity of the micro closed electric field generated at the boundary between the first and second regions does not occur, the electric field at the time when the first region is charged is maintained and toner conveyance is maintained. Since the second region is almost not charged, the charge damping time constant in the first region on the surface of the electrophotographic member is equal to a charge damping time constant on the entire surface of the electrophotographic member. By measuring the charge damping on the surface of the electrophotographic member, therefore, the intensity of the micro closed electric field and toner conveying power depending thereon can be measured. The degree of charge damping can be compared by measuring a time-dependent change of charges of the surface potential and determining the time constant from the damping characteristics. The time constant of the electrophotographic member is preferably 60 seconds or more, more preferably 300 seconds or more. By providing the first region so as to give a time constant of the above-described range, an electrophotographic member excellent in toner conveyance can be obtained.

As a material constituting the insulating first region, various insulating materials can be used. The material is preferably a relatively crack-resistant when deformed due to contact of the electrophotographic member with another member. Specific examples include metal oxides such as silicon dioxide and aluminum oxide and inorganic substances such as diamond. Additional examples include resins such as polyethylene, polystyrene, polycarbonate, polyacrylate, polytetrafluoroethylene, phenolic resins, urea resins, silicone resins and polyimide resins. Due to large electrical resistance, crack resistance even if some deformation occurs and durability against sliding and rubbing, resins such as polystyrene, polyacrylate, polytetrafluoroethylene, silicone resins and polyimide resins and copolymers thereof are particularly preferred.

Examples of a method of forming the insulating first region include a method of using a unit such as vapor deposition or CVD (chemical vapor deposition) to form the insulating first region with a desired distribution pattern on the outer surface of the coating layer. When the insulating first region is made of a resin-containing material, a method of dissolving the above-described resin in a solvent to obtain a first region forming material in liquid form, attaching the forming material to the outer surface of the coating layer with a desired distribution pattern and then drying and curing the resulting forming material in liquid form can be used. Another method is to add a curable curing agent to the above-described resin to obtain a first region forming material, attach the resulting first region forming material to the outer surface of the coating layer with a desired distribution pattern and then cure the material. It is also possible to use, in combination, the above-described method of dissolving the resin in a solvent and the method of using a curable curing agent.

The elastic modulus of the electrical insulating first region can be measured using the smooth cross-section of the electrical insulating first region with an SPM (scanning probe microscope).

Examples of the method of attaching the first region forming material in liquid form to the surface of the coating layer include a method of jetting liquid droplets by a jet dispenser to attach them to the surface and a method of printing the first region forming material on any patterned region by screen printing. By a method of coating the first region forming material by roll coating, spraying or dipping, the first region can also be provided. In this case, by the first region forming material, two regions are formed on the surface of the coating layer, that is, a region where liquid droplets are present collectively due to surface tension to the coating layer and the other region having no liquid droplets thereon due to cissing. The method of attaching the insulating first region with a desired distribution pattern is preferably the above-described method using cissing because it is capable of arranging the first region forming material easily and stably without seams.

In the above-described method of attaching the first region forming material in liquid form to the surface of the coating layer by making use of cissing, by substantially uniformly roughening the surface of the coating layer, the distribution of cissing of the first region forming material can be made uniform on the surface of the electrophotographic member. Examples of the method of uniformly roughening the surface include a method of causing phase separation or expansion at the time of forming the coating layer and thereby autonomously roughening the surface and a method of adding roughening particles as an ingredient of the coating layer forming material and thereby forming the coating layer. The method of adding roughening particles capable of roughening the surface simply, stably and uniformly is preferably used.

The first region has preferably an elastic modulus larger than that of the coating layer. The larger elastic modulus is preferred because it increases durability against cracking caused by expansion and contraction during use for a long period of time.

In the above-described method of attaching the first region forming material in liquid form to the surface of the coating layer by making use of cissing, an area ratio of the electrical insulating first region is adjusted by controlling the solid content of the coating material in the first region forming material. An increase in the solid content of the resin in the first region forming material leads to an increase in the area ratio of the first region, while a decrease in the solid content leads to a decrease in the area ratio of the first region.

In the first region forming material, the solid content of the resin in an evaporative solvent is adjusted to from 10 to 40%. In particular, when a dipping method is used in the method of attaching the first region forming material in liquid form to the surface of the coating layer by making use of cissing, an increase in pull-up speed upon coating increases an attached amount of the first region forming material. At the same time, it increases the area ratio of the first region. A decrease in the pull-up speed decreases the attached amount of the first region forming material and also decreases the area ratio of the first region. In the present disclosure, the pull-up speed upon coating is adjusted to from 20 to 5000 mm/min. The length of the boundary line between the electrical insulating first region and the electroconductive second region per unit area changes depending on the state of the rough surface of the coating layer when the solid content of the resin or pull-up speed upon coating is the same. In order to increase the length of the boundary line, it is only necessary to add a relatively large amount of roughening particles having a small average particle size, while in order to relatively decrease the length of the boundary line, it is only necessary to add a relatively small amount of roughening particles having a relatively large average particle size.

<Confirmation of First Region and Second Region>

First, the outer surface of the electrophotographic member is observed under an optical microscope, scanning electron microscope or the like and when there are two or more regions, presence of the first region and the second region can be confirmed.

Further, by charging the outer surface of the electrophotographic member including the first region and the second region and then measuring the residual potential distribution thereof, it can be confirmed that the first region is electrically insulating and the second region has higher conductivity than the first region.

The residual potential distribution can be determined by sufficiently charging the outer surface of the electrophotographic member by using a charging device such as corona discharge device and then measuring the residual potential distribution of the charged outer surface of the electrophotographic member with an electrostatic force microscope (EFM), a surface potential microscope (KFM) or the like.

The electrical insulating properties of the first region and the conductivity of the second region can also be evaluated by, in addition to the volume resistivity, the potential damping time constant (which may also be called "time constant") of a residual potential.

The time constant of a residual potential is defined as a time required for damping of a residual potential to 1/e of an initial value and it becomes an indicator how easily a charged potential is retained, in which e is the base of natural logarithms. The time constant of the first region equal to or more than 60.0 seconds is preferred because it enables smooth charging of the first region and at the same time facilitates retention of the potential obtained by charging. On the other hand, the time constant of the second region less than 6.0 seconds is preferred because it suppresses the second region from being charged and makes it easy to cause a potential difference between the second region and the charged first region and exhibit a gradient force. It is to be noted that in the measurement of the time constant, when a residual potential is substantially 0 V at the measurement starting point in the below-described measuring method, in other words, when a potential has been completely damped at the measurement starting point, the time constant at the measurement point is regarded as less than 6.0 seconds. The time constant of a residual potential can be determined, for example, by sufficiently charging the outer surface of a developing roller by using a charging device such as corona discharge device and then measuring a time-dependent change of the residual potential of the first region and the second region of the charged outer surface of the developing roller by an electrostatic force microscope (EFM).

[Electrophotographic Process Cartridge and Electrophotographic Image Forming Apparatus]

The electrophotographic image forming apparatus according to the present disclosure has a photoreceptor drum as an image carrier for forming and carrying an electrostatic latent image, a charging member as a charging unit for charging the photoreceptor drum and an exposure device for forming the electrostatic latent image on the charged photoreceptor drum. The electrophotographic image forming apparatus further has a developing unit for developing the electrostatic latent image with a toner to form a toner image and a transfer roller as a transfer unit for transferring the toner image to a transfer material. The developing unit has the above-described electrophotographic member, for example as a developing roller.

Figure 6:
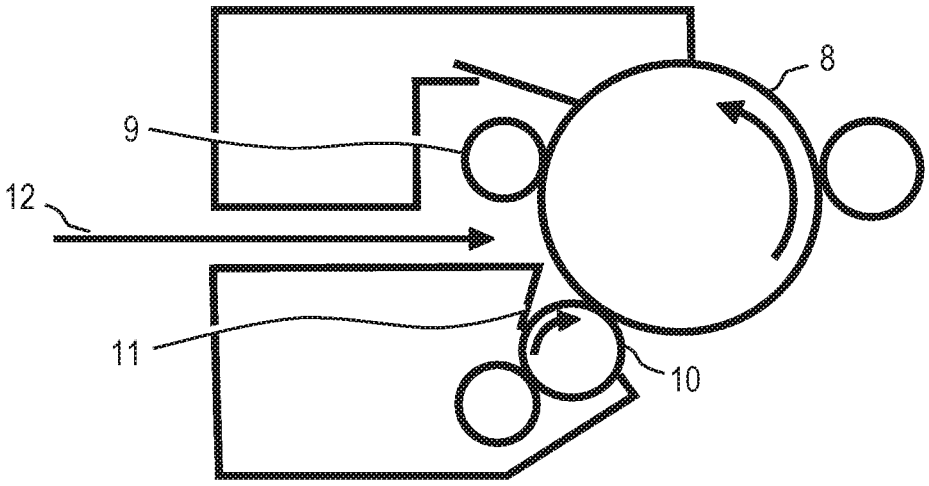
FIG. 6 is a cross-sectional view showing one example of the electrophotographic process cartridge relating to the present disclosure.
Figure 7:
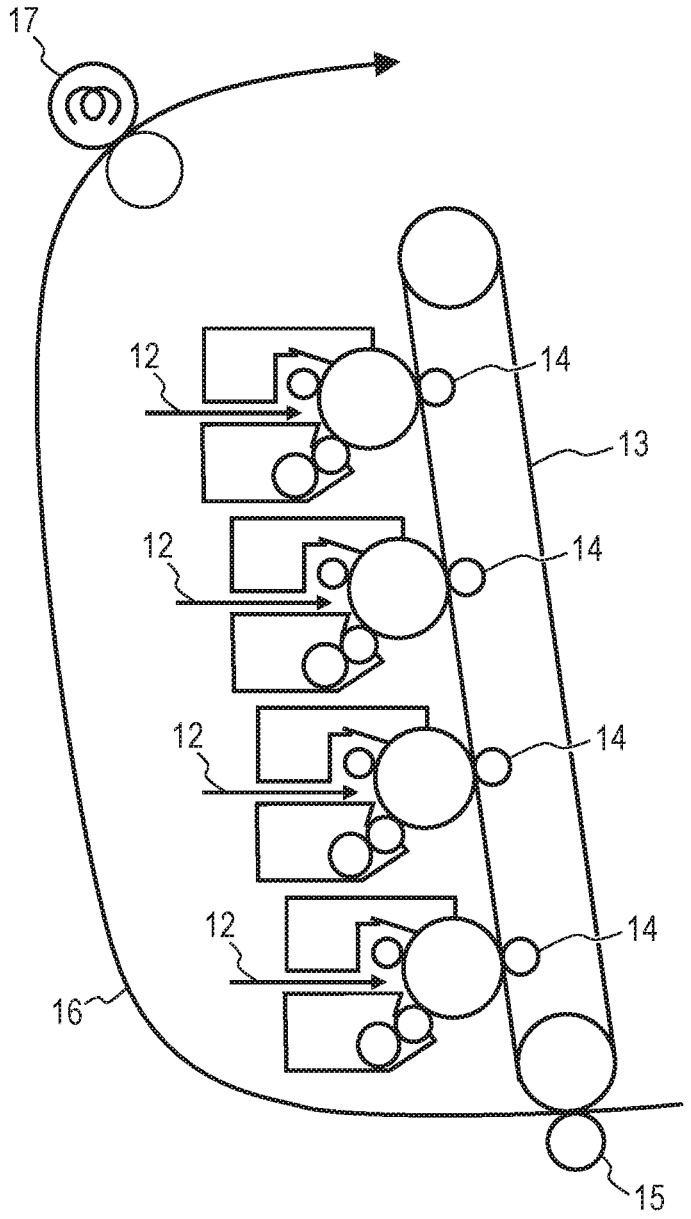
FIG. 7 is a cross-sectional view showing one example of the electrophotographic image forming apparatus relating to the present disclosure.

FIG. 7 schematically shows one example of the electrophotographic image forming apparatus according to the present disclosure. FIG. 6 schematically shows an electrophotographic process cartridge to be loaded on the electrophotographic image forming apparatus shown in FIG. 7. This electrophotographic process cartridge has therein a photoreceptor drum 8, a charging member 9, an electrophotographic member 10 and a toner regulating member 11. The electrophotographic process cartridge is detachably mounted on the main body of the electrophotographic image forming apparatus shown in FIG. 7.

The photoreceptor drum 8 is charged (primarily charged) uniformly by the charging member 9 connected to a bias power source not shown. At this time, the charge potential of the photoreceptor drum serving as an image carrier is, for example, −800 V or more to −400 V or less. Next, an exposure light 12 for writing an electrostatic latent image is irradiated to the photoreceptor drum from an exposure device not shown and the electrostatic latent image is formed on the surface of the drum. As the exposure light, either an LED light or a laser light can be used. The surface potential of an exposed portion of the photoreceptor drum is, for example, −200 V or more to −100 V or less.

A negative-polarity charged toner is given to the electrostatic latent image (developed) by the electrophotographic member 10 to form a toner image on the photoreceptor drum and the electrostatic latent image is converted into a visible image. At this time, a voltage of, for example, −500 V or more to −300 V or less is applied to the electrophotographic member by a bias power source not shown here. It is to be noted that the electrophotographic member is in contact with the photoreceptor drum with a nip width of, for example, 0.5 mm or more to 3 mm or less.

Primary transfer of the toner image developed on the photoreceptor drum to an intermediate transfer belt 13 is then performed. A primary transfer member 14 is in contact with the rear surface of the intermediate transfer belt 13. By applying a voltage of, for example, +100 V or more to +1500 V or less to the primary transfer member 14, primary transfer of the negative polarity toner image from the photoreceptor drum to the intermediate transfer belt 13 is performed. The primary transfer member 14 may be either a roller form or a blade form.

When the electrophotographic image forming apparatus is a full-color image forming apparatus, each of the above-described charging, exposure, development and primary transfer steps is typically performed for each of yellow, cyan, magenta and black colors. In the electrophotographic image forming apparatus shown in FIG. 7, therefore, a total of four electrophotographic process cartridges having therein these four color toners, respectively, are mounted detachably on the main body of the electrophotographic image forming apparatus. The above charging, exposure, development and primary transfer steps are performed successively with a predetermined time difference to create an overlapped state of four-color toner images on the intermediate transfer belt 13 for expressing a full color image.

The toner images on the intermediate transfer belt 13 are conveyed to a position facing a secondary transfer member 15 with the rotation of the intermediate transfer belt 13. Between the intermediate transfer belt 13 and the secondary transfer member 15, recording paper is conveyed along a recording paper conveying route 16 at a predetermined timing and by application of a secondary transfer bias to the secondary transfer member 15, the toner images on the intermediate transfer belt 13 are transferred to the recording paper. At this time, the bias voltage applied to the secondary transfer member 15 is, for example, +1000 V or more to +4000 V or less. The recording paper onto which the toner images are transferred by the secondary transfer member 15 is conveyed to a fixing device 17 and after the toner images on the recording paper are melted and fixed onto the recording paper, the resulting recording paper is ejected from the electrophotographic image forming apparatus to complete the printing operation.

According to one aspect of the invention, an electrophotographic member capable of suppressing a reduction in image density even if used for a long period of time under a high-temperature and high-humidity severe environment can be provided. In other words, an electrophotographic member capable of preventing generation of minute cracks due to a repeated stress, decreasing a reduction in the electrical resistivity of an insulating region caused by invasion of water therein, maintaining the intensity of a micro closed electric field and thereby conveying a large amount of toner stably can be provided.

According to another aspect of the invention, an electrophotographic process cartridge and an electrophotographic image forming apparatus capable of stably forming a high-quality electrophotographic image can be obtained.

EXAMPLES

By Manufacturing examples and Examples, respective constitutions of the electrophotographic member, electrophotographic process cartridge and electrophotographic image forming apparatus according to the present disclosure will hereinafter be described specifically. The electrophotographic member, electrophotographic process cartridge and electrophotographic image forming apparatus according to the present disclosure are not limited to them.

[Physical-Property Measuring Environment of Electrophotographic Member]

The elastic modulus and electrical resistivity of the electrophotographic member were all measured in a high-temperature and high-humidity environment at 30° C. and a relative humidity of 80% after leaving it to stand in the same environment for 12 hours or more.

Microscopic observation was performed in a normal temperature and normal humidity environment at 22° C. and a relative humidity of 50% after leaving it to stand in the same environment for 12 hours or more.

<Measurement of Elastic Modulus of Elastic Layer>

With a sharp cutting tool, the electrophotographic member was cut at a plane perpendicular to the axial direction thereof to obtain a 0.5 mm-thick elastic layer sample. The sample thus obtained was placed on a glass substrate and the elastic modulus of it was measured using a Martens hardness tester ("PICODENTOR HM-500", trade name; product of Helmut Fischer, which will also be used hereinafter as the Martens hardness tester). The measurement was made using a quadrangular pyramid-shaped diamond as a measurement indenter under the conditions of an indenter entry speed of 100 nm/sec, a maximum indentation load of 3 mN, an indentation time for 10 seconds and a creep time for 10 seconds. Measurement was performed at three points, that is, at both end portions and center portion in the axial direction of the electrophotographic member and an arithmetic mean value of the measurement results thus obtained was calculated and designated as the elastic modulus of the elastic layer.

<Measurement of Elastic Modulus of Coating Layer>

With a microtome, the electrophotographic member was cut at a plane perpendicular to the axial direction thereof to obtain its near surface sample including a 20 μm-thick coating layer. The sample thus obtained was placed on a glass substrate and the elastic modulus of the coating layer was measured using a Martens hardness tester. The measurement was made using a quadrangular pyramid-shaped diamond as a measurement indenter under the conditions of an indenter entry speed of 100 nm/sec, a maximum indentation load of 3 mN, an indentation time for 10 seconds and a creep time for 10 seconds. Measurement was performed at three points, that is, at both end portions and center portion in the axial direction of the electrophotographic member and an arithmetic mean value of the measurement results thus obtained was calculated and designated as the elastic modulus of the coating layer.

<Measurement of Elastic Modulus of Electrical Insulating First Region>

A near-surface sample of the electrophotographic member including a 1-mm thick electrical insulating first region was cut at a plane perpendicular to the axial direction of the electrophotographic member. After fixing the resulting sample with an acrylic burying resin, the cross-section of the electrophotographic member including the electrical insulating first region perpendicular to the axial direction was exposed with a microtome. The sample thus obtained was placed on a glass substrate and first, the elastic modulus of the acrylic burying resin was measured using a Martens hardness tester. Measurement conditions were similar to those for the coating layer and measurement was performed using a quadrangular pyramid-shaped diamond as an indenter under the conditions of an indenter entry speed of 100 nm/sec, a maximum indentation load of 3 mN, an indentation time for 10 seconds and a creep time for 10 seconds. Next, the sample was placed on a glass substrate and measured using SPM ("MFP-3D Origin", trade name; product of Oxford Instruments) in an AFM mode. The viscoelasticity of each of the acrylic burying resin portion and the electrical insulating first region to be measured was measured and from their ratio, an elastic modulus of the electrical insulating first region was calculated. Measurement was performed at three points, that is, at both end portions and center portion in the axial direction of the electrophotographic member and an arithmetic mean value of the measurement results thus obtained was calculated and designated as the elastic modulus of the first region.

<Measurement of Volume Resistivity of Elastic Layer>

With a sharp cutting tool, a 0.5-mm thick elastic layer sample of the electrophotographic member was cut at a plane perpendicular to the axial direction thereof. The sample thus obtained was placed on a lower electrode made of a smooth stainless plate. After it was sandwiched between the lower electrode and a round upper electrode having a diameter of 0.5 mm and made of stainless, a voltage of 1 V was applied and an average current value for 10 seconds from 30 seconds to 40 seconds after the application was started was measured. Based on the voltage applied to the electrodes, a current flowing therebetween, a thickness of the sample and the area of the electrode, the volume resistivity was calculated. For the measurement, a micro current meter ("ADVANTEST R8340A ULTRA HIGH RESISTANCE METER", trade name; product of Advantest, which will also be used hereinafter as the micro current meter) was used. Measurement was performed at three points, that is, at both end portions and center portion in the axial direction of the electrophotographic member and an arithmetic mean value of the measurement results thus obtained was calculated and designated as the volume resistivity of the elastic layer.

<Measurement of Volume Resistivity of Coating Layer>

With a microtome, the electrophotographic member was cut at a plane perpendicular to the axial direction thereof to obtain a 2-μm thick coating layer sample. The sample thus obtained was placed on a lower electrode made of a smooth stainless plate. After it was sandwiched between the lower electrode and a round upper electrode having a diameter of 2 μm and made of stainless, a voltage of 1 V was applied and an average current value for 10 seconds from 30 seconds to 40 seconds after the application was started was measured. Based on the voltage applied to the electrodes, a current flowing therebetween, a thickness of the thin sample and the area of the electrode, the volume resistivity was calculated. A micro current meter was used for the measurement. The measurement was performed at three points, that is, at both end portions and center portion in the axial direction of the electrophotographic member and an arithmetic mean value of the measurement results thus obtained was calculated and designated as the volume resistivity of the coating layer.

<Measurement of Volume Resistivity of Electrical Insulating First Region>

With FIB, the electrophotographic member was cut at a plane substantially parallel to the surface thereof to obtain a 0.5-μm thick first region sample such that the sample does not include the second region. The sample thus obtained was placed on a lower electrode made of a smooth stainless plate. After it was sandwiched between the lower electrode and a round upper electrode having a diameter of 2 μm and made of stainless such that the whole surface of the electrode is brought into contact with the insulating part, a voltage of 0.5 V was applied. An average current value for 10 seconds from 30 seconds to 40 seconds after the application was started was measured. Based on the voltage applied to the electrodes, a current flowing therebetween, a thickness of the thin sample and the area of the electrode, the volume resistivity was calculated. For the measurement, a micro current meter was used.

<Height, Width and Density of First Protrusion>

With a sharp cutting tool, the electrophotographic member was cut at a cross-section perpendicular to a radius direction and parallel to the axial direction thereof to obtain a 0.5-mm thick elastic layer sample. With a confocal optical microscope ("VK-8700", trade name; product of Keyence), the cross-section image of it was photographed. The photographing magnification ratio was set so that a photographing range in a direction perpendicular to the film thickness becomes from 20 times to 50 times magnification based on the film thickness of the coating layer. On the image, a profile of an interface between the elastic layer and the coating layer was extracted. In the profile of the interface, the height and width of portions protruding from the base line to the outside of the electrophotographic member were measured and averaged to obtain a first protrusion height and a first protrusion width, respectively. The number of protrusions on the image was counted and a first protrusion density was determined by calculation based on the number and the image width.

Measurement was performed at three points, that is, at both end portions and the center portion in the axial direction of the electrophotographic member. Arithmetic mean values of the measurement results were calculated and designated as first protrusion height, protrusion width and protrusion density, respectively.

<Correlation Between Thickness of Coating Layer and First and Second Protrusions>

Using the image of the cross-section, a film thickness on the image was measured at 10 points on the image with a constant interval and the values thus obtained were averaged to obtain a film thickness of the coating layer. From the image of the cross-section, a profile of the surface of the electrophotographic member was extracted and the profile of the interface between the elastic layer and the coating layer was compared with their profiles at the horizontal-direction position and a correlation coefficient was calculated. Measurement was performed at three points, that is, at both end portions and the center portion in the axial direction of the electrophotographic member and an arithmetic mean value of the resulting measurement results was calculated and used.

<Area Ratio of Electrical Insulating First Region>

The surface of the electrophotographic member was photographed with a confocal optical microscope ("VK-8700", trade name; product of Keyence) from a direction perpendicular to the surface to obtain a surface image. From the surface image, the first region was extracted and a ratio of it to a total area was calculated. Measurement was performed at three points, that is, at both end portions and the center portion of the electrophotographic member in the axial direction and an arithmetic mean value of the resulting measurement results was calculated and designated as an area ratio of the first region.

[Manufacture of Elastic Layer Forming Mold]

Super duralumin was processed into a pipe-shaped mold having an inner diameter of 10 mm and a length of 240 mm. The inner surface of the pipe-shaped mold was smoothened into a surface roughness Ra of 1.0 μm. Then, the pipe-shaped mold was subjected to alumite treatment with a solution containing 0.3 part by mass of PTFE (polytetrafluoroethylene) particles having an average particle size of 0.2 μm and 0.1 part by mass of a cationic surfactant. Many recesses were formed on the inner surface of the mold as a result of aggregation of the PTFE particles. The resulting mold was designated as Elastic layer forming mold 1. In a manner similar to that used for the manufacture of Elastic layer forming mold 1 except that the respective amounts of the PTFE particles and the cationic surfactant for Elastic layer forming mold 1 were changed as shown in Table 1, Elastic layer forming molds 2 to 13 were manufactured.

TABLE 1

| Mold | Particle size of PTFE particles μm | Amount of PTFE particle part by mass | Amount of cationic surfactant parts by mass |
|---|---|---|---|
| Elastic layer forming mold 1 | 0.5 | 0.03 | 0.1 |
| Elastic layer forming mold 2 | 0.5 | 0.005 | 0.1 |
| Elastic layer forming mold 3 | 0.5 | 0.1 | 0.1 |
| Elastic layer forming mold 4 | 0.5 | 0.015 | 0.15 |
| Elastic layer forming mold 5 | 0.5 | 0.06 | 0.06 |
| Elastic layer forming mold 6 | 0.2 | 0.03 | 0.1 |
| Elastic layer forming mold 7 | 0.2 | 0.15 | 0.4 |
| Elastic layer forming mold 8 | 0.5 | 0.008 | 0.08 |
| Elastic layer forming mold 9 | 0.5 | 0.008 | 0.06 |
| Elastic layer forming mold 10 | 0.5 | 0.07 | 0.3 |

TABLE 1-continued

| Mold | Particle size of PTFE particles μm | Amount of PTFE particle part by mass | Amount of cationic surfactant parts by mass |
|---|---|---|---|
| Elastic layer forming mold 11 | 0.5 | 0.07 | 0.15 |
| Elastic layer forming mold 12 | 1 | 2 | 0.1 |
| Elastic layer forming mold 13 | 1 | 3.5 | 0.1 |

[Preparation of Elastic Layer Forming Conductive Silicone Rubber Material]

100 Parts by mass of dimethylsiloxane terminated at both ends of the molecular chain thereof with a dimethylvinylsiloxy group and having a viscosity of 50,000 mPa·s (vinyl group content: 0.03 mass %) ("DMS-V46", trade name; product of Gelest), 5 parts of wet process silica having a BET specific surface area of 200 $m^2/g$ and, as Carbon black 1, 10 parts of carbon black ("HS-100", trade name; product of Denka) were mixed until the mixture became uniform to prepare a main agent composition in paste form.

To 115 parts of the main agent composition in paste form was added 2.4 parts by mass of a platinum-1,3-divinyl-1,1,3,3-tetramethyldisiloxane complex (platinum content of 0.5 mass %) ("SIP6832.2", trade name; product of Gelest) and the resulting mixture was mixed uniformly to prepare a catalyst composition in liquid form.

To 115 parts of the main agent composition in paste form was added 25 parts by mass of a methyl hydrogen siloxane-dimethylsiloxane copolymer ("HMS-151", trade name; product of Gelest) represented by the following average molecular formula: $Me_3SiO(MeHSiO)_3(Me_2SiO)_3SiMe_3$ and the resulting mixture was mixed uniformly to prepare a curing agent composition in liquid form.

The catalyst composition and the curing agent composition were mixed in equal amounts just before formation and an electro-conductive silicone rubber material for forming an elastic layer was obtained. The resulting material was designated as Elastic layer forming material 1.

In a manner similar to that used for the preparation of Elastic layer forming material 1 except that the viscosity (polymer viscosity) and the vinyl group content of the dimethylsiloxane terminated at both ends of the molecular chain thereof with a dimethylvinylsiloxy group were changed as shown in Table 2, Elastic layer forming materials 2 to 5 were obtained.

TABLE 2

| Material | Viscosity of polymer (mPa · s) | Vinyl group content (wt %) |
|---|---|---|
| Elastic layer forming material 1 | 50000 | 0.03 |
| Elastic layer forming material 2 | 200000 | 0.007 |
| Elastic layer forming material 3 | 30000 | 0.045 |
| Elastic layer forming material 4 | 500000 | 0.003 |
| Elastic layer forming material 5 | 10000 | 0.14 |

[Preparation of Coating-Layer Forming Coating Material]

Coating layer forming materials are shown in the following Table 3.

TABLE 3

| Name | Material |
|---|---|
| Polyol 1 | Polyether polyol<br>("PTG-L3500", trade name; product of Hodogaya Chemical) |
| Polyol 2 | Polyether polyol<br>("Excenol 420", trade name; product of AGC) |
| Isocyanate 1 | Polymeric MDI<br>("Millionate MR-200", trade name; product of TOSOH) |
| Modified silicone 1 | Polyether-modified silicone oil<br>("TSF4445", trade name; product of Momentive Performance Materials Japan Limited Liability) |
| Carbon black 2 | Carbon black (Furnace black)<br>("Sunblack X55", trade name; product of Asahi Carbon) |
| Particle 1 | Spherical crossl-linked urethane beads, average particle size of 3 μm<br>("Art-pearl C-1000 clear", trade name, product of Negami Chemical Industrial) |
| Particle 2 | Spherical crossl-linked urethane beads, average particle size of 6 μm<br>("Art-pearl C-800 clear", trade name, product of Negami Chemical Industrial) |
| Particle 3 | Spherical crossl-linked urethane beads, average particle size of 10 μm<br>("Art-pearl C-600", trade name, clear, product of Negami Chemical Industrial) |
| Particle 4 | Spherical crossl-linked urethane beads, average particle size of 15 μm<br>("Art-pearl C-400 clear", trade name, product of Negami Chemical Industrial) |
| Particle 5 | Spherical crossl-linked urethane beads, average particle size of 22 μm<br>("Art-pearl C-300 clear", trade name, product of Negami Chemical Industrial) |
| Particle 6 | Spherical crossl-linked urethane beads, average particle size of 32 μm<br>("Art-pearl C-200 clear", trade name, product of Negami Chemical Industrial) |
| Solvent 1 | Methyl ethyl ketone<br>(solvent, product of Kishida Chemical) |

The following materials were mixed in a container.

| | |
|---|---|
| Polyol 1 | 100.0 g |
| Polyol 2 | 20.0 g |
| Isocyanate 1 | 33.7 g |
| Modified silicone 1 | 1.5 g |
| Carbon black 2 | 35.3 g |
| Particle 4 | 7.7 g |
| Solvent 1 | 587.2 g |

In a sand mill filled 80 mass % with glass beads having a particle size of 1.5 mm, the resulting mixture was dispersed for one hour at a peripheral speed of 4 m/s while keeping the temperature at 20° C. or more to less than 26° C. The resulting dispersion was filtered through a #100 nylon mesh to obtain Coating-layer forming coating material 1.

In a manner similar to that used for preparation of Coating-layer forming coating material 1 except that the composition was changed as shown in Table 4, Coating-layer forming coating materials 2 to 26 were prepared.

TABLE 4

| Coating layer-forming coating material No. | Polyol 1 (g) | Polyol 2 (g) | Isocyanate 1 (g) | Modified silicone 1 (g) | Carbon black 2 (g) | Kind of particle | Mixed amount of particle (g) | Solvent 1 (g) |
|---|---|---|---|---|---|---|---|---|
| 1 | 100.0 | 20.0 | 33.7 | 1.5 | 35.3 | Particle 4 | 7.7 | 587.2 |
| 2 | 100.0 | 2.0 | 14.2 | 1.2 | 26.7 | Particle 4 | 5.8 | 444.0 |
| 3 | 50.0 | 50.0 | 60.1 | 1.6 | 36.8 | Particle 4 | 8.0 | 611.7 |
| 4 | 100.0 | 0.0 | 7.5 | 1.1 | 24.7 | Particle 4 | 5.4 | 410.8 |
| 5 | 2.0 | 100.0 | 108.4 | 2.1 | 48.4 | Particle 4 | 10.5 | 803.9 |
| 6 | 100.0 | 20.0 | 33.7 | 1.5 | 40.0 | Particle 4 | 7.7 | 600.9 |
| 7 | 100.0 | 2.0 | 14.2 | 1.2 | 30.2 | Particle 4 | 5.8 | 454.4 |
| 8 | 50.0 | 50.0 | 60.1 | 1.6 | 41.6 | Particle 4 | 8.0 | 626.1 |
| 9 | 100.0 | 0.0 | 7.5 | 1.1 | 28.0 | Particle 4 | 5.4 | 420.4 |
| 10 | 2.0 | 100.0 | 108.4 | 2.1 | 54.7 | Particle 4 | 10.5 | 822.8 |
| 11 | 100.0 | 20.0 | 33.7 | 1.5 | 30.7 | Particle 4 | 7.7 | 573.4 |
| 12 | 100.0 | 20.0 | 33.7 | 1.5 | 27.7 | Particle 4 | 7.7 | 564.2 |
| 13 | 100.0 | 20.0 | 33.7 | 1.5 | 35.3 | Particle 2 | 7.7 | 948.9 |
| 14 | 100.0 | 20.0 | 33.7 | 1.5 | 35.3 | Particle 3 | 7.7 | 714.3 |
| 15 | 100.0 | 20.0 | 33.7 | 1.5 | 35.3 | Particle 5 | 7.7 | 489.6 |
| 16 | 100.0 | 20.0 | 33.7 | 1.5 | 35.3 | Particle 6 | 7.7 | 417.9 |
| 17 | 100.0 | 20.0 | 33.7 | 1.5 | 35.3 | Particle 4 | 23.1 | 587.2 |
| 18 | 100.0 | 20.0 | 33.7 | 1.5 | 35.3 | Particle 2 | 23.1 | 948.9 |
| 19 | 100.0 | 20.0 | 33.7 | 1.5 | 35.3 | Particle 3 | 23.1 | 714.3 |
| 20 | 100.0 | 20.0 | 33.7 | 1.5 | 35.3 | Particle 5 | 23.1 | 489.6 |
| 21 | 100.0 | 20.0 | 33.7 | 1.5 | 35.3 | Particle 6 | 23.1 | 417.9 |
| 22 | 100.0 | 20.0 | 33.7 | 1.5 | 35.3 | Particle 3 | 7.7 | 587.2 |

TABLE 4-continued

| Coating layer-forming coating material No. | Polyol 1 (g) | Polyol 2 (g) | Isocyanate 1 (g) | Modified silicone 1 (g) | Carbon black 2 (g) | Kind of particle | Mixed amount of particle (g) | Solvent 1 (g) |
|---|---|---|---|---|---|---|---|---|
| 23 | 100.0 | 20.0 | 33.7 | 1.5 | 35.3 | Particle 1 | 7.7 | 948.9 |
| 24 | 100.0 | 20.0 | 33.7 | 1.5 | 35.3 | Particle 2 | 7.7 | 714.3 |
| 25 | 100.0 | 20.0 | 33.7 | 1.5 | 35.3 | Particle 4 | 7.7 | 489.6 |
| 26 | 100.0 | 20.0 | 33.7 | 1.5 | 35.3 | Particle 5 | 7.7 | 417.9 |

[Preparation of Insulating Part Coating Material]

Insulating part forming materials are shown in the following Table 5.

TABLE 5

| Name | Material |
|---|---|
| Acrylate 1 | Tetramethylolmethane tetraacrylate ("NK ester A-TMMT", trade name, product of Shin-nakamura Chemical) |
| Acrylate 2 | PO-modified neopentylglycol diacrylate ("EBECRYL 145", trade name; product of Daicel Allnex) |
| Acrylate 3 | Triethylene glycol dimethacrylate ("NK ester 3G", trade name; product of Shin-nakamura Chemical) |
| Styrene 1 | Styrene monomer (product of Kishida Chemical) |
| Divinylbenzene 1 | Divinylbenzene (product of Kishida Chemical) |
| Initiator 1 | 1-Hydroxy-cyclohexyl pheny lketone ("IRGACURE 184", trade name; product of BASF) |
| Solvent 1 | Methyl ethyl ketone (Solvent: product of Kishida Chemical) |

The following materials were mixed in a container at a place not exposed to ultraviolet rays.

| | |
|---|---|
| Acrylate 1 | 200.0 g |
| Acrylate 2 | 500.0 g |
| Styrene 1 | 500.0 g |
| Initiator 1 | 60.0 g |
| Solvent 1 | 566.1 g |

The mixture thus obtained was stirred and mixed sufficiently and the resulting mixture was filtered through a #300 nylon mesh to obtain Insulating part material 1.

In a manner similar to that used for the preparation of Insulating part coating material 1 except that the composition was changed as shown in Table 6, Insulating part coating materials 2 to 8 were prepared.

Example 1

[Manufacture of Elastic Base Layer Roller]

As an electro-conductive substrate, a plated iron shaft having an outer diameter of 6 mm and a length of 270 mm, made of SUM22 and subjected to KN plating with a thickness of 6 μm was provided. A primer ("DY35-051", trade name; product of Dow Corning Toray) was applied to the shaft, followed by backing. Elastic layer forming mold 1, insert pieces for fixing a shaft core to both ends of the Elastic layer forming mold 1 and the shaft core were fabricated and Elastic layer forming material 1 was poured from one of the insert pieces into the inner surface, followed by heating at 150° C. for 20 minutes. After cooling, the resulting material was released from the mold and heated for 5 hours in an oven of 200° C. to obtain Elastic base layer roller 1 having a 2.0-mm thick elastic layer around the shaft core and having a first protrusion.

In a manner similar to that used for the manufacture of Elastic base layer roller 1 except that a combination of the elastic layer forming mold and the elastic layer forming material was changed as shown in FIG. 7, Elastic base layer rollers 2 to 25 were obtained.

TABLE 6

| Material | Acrylate 1 | Acrylate 2 | Acrylate 3 | Styrene 1 | Divinylbenzene 1 | Initiator 1 | Solvent 1 |
|---|---|---|---|---|---|---|---|
| Insulating part material 1 | 200.0 | 500.0 | 0.0 | 500.0 | 0.0 | 60.0 | 566.1 |
| Insulating part material 2 | 200.0 | 1000.0 | 0.0 | 0.0 | 0.0 | 60.0 | 566.1 |
| Insulating part material 3 | 200.0 | 0.0 | 0.0 | 900.0 | 100.0 | 60.0 | 566.1 |
| Insulating part material 4 | 200.0 | 200.0 | 800.0 | 0.0 | 0.0 | 60.0 | 566.1 |
| Insulating part material 5 | 200.0 | 500.0 | 0.0 | 500.0 | 0.0 | 60.0 | 315.0 |
| Insulating part material 6 | 200.0 | 500.0 | 0.0 | 500.0 | 0.0 | 60.0 | 708.6 |
| Insulating part material 7 | 200.0 | 500.0 | 0.0 | 500.0 | 0.0 | 60.0 | 140.0 |
| Insulating part material 8 | 200.0 | 500.0 | 0.0 | 500.0 | 0.0 | 60.0 | 772.3 |

TABLE 7

| Name of roller | Mold | Material |
|---|---|---|
| Elastic base layer roller 1 | Elastic layer forming mold 1 | Elastic layer forming material 1 |
| Elastic base layer roller 2 | Elastic layer forming mold 2 | Elastic layer forming material 1 |
| Elastic base layer roller 3 | Elastic layer forming mold 3 | Elastic layer forming material 1 |
| Elastic base layer roller 4 | Elastic layer forming mold 4 | Elastic layer forming material 1 |
| Elastic base layer roller 5 | Elastic layer forming mold 5 | Elastic layer forming material 1 |
| Elastic base layer roller 6 | Elastic layer forming mold 6 | Elastic layer forming material 1 |
| Elastic base layer roller 7 | Elastic layer forming mold 7 | Elastic layer forming material 1 |
| Elastic base layer roller 8 | Elastic layer forming mold 8 | Elastic layer forming material 1 |
| Elastic base layer roller 9 | Elastic layer forming mold 9 | Elastic layer forming material 1 |
| Elastic base layer roller 10 | Elastic layer forming mold 10 | Elastic layer forming material 1 |
| Elastic base layer roller 11 | Elastic layer forming mold 11 | Elastic layer forming material 1 |
| Elastic base layer roller 12 | Elastic layer forming mold 12 | Elastic layer forming material 1 |
| Elastic base layer roller 13 | Elastic layer forming mold 13 | Elastic layer forming material 1 |
| Elastic base layer roller 14 | Elastic layer forming mold 1 | Elastic layer forming material 2 |
| Elastic base layer roller 15 | Elastic layer forming mold 8 | Elastic layer forming material 2 |
| Elastic base layer roller 16 | Elastic layer forming mold 11 | Elastic layer forming material 2 |
| Elastic base layer roller 17 | Elastic layer forming mold 1 | Elastic layer forming material 3 |
| Elastic base layer roller 18 | Elastic layer forming mold 8 | Elastic layer forming material 3 |
| Elastic base layer roller 19 | Elastic layer forming mold 11 | Elastic layer forming material 3 |
| Elastic base layer roller 20 | Elastic layer forming mold 1 | Elastic layer forming material 4 |
| Elastic base layer roller 21 | Elastic layer forming mold 8 | Elastic layer forming material 4 |
| Elastic base layer roller 22 | Elastic layer forming mold 11 | Elastic layer forming material 4 |
| Elastic base layer roller 23 | Elastic layer forming mold 1 | Elastic layer forming material 5 |
| Elastic base layer roller 24 | Elastic layer forming mold 8 | Elastic layer forming material 5 |
| Elastic base layer roller 25 | Elastic layer forming mold 11 | Elastic layer forming material 5 |

[Formation of Coating Layer]

Elastic base layer roller 1 was dip coated with Coating-layer forming coating material 1 to form a coating layer. While holding an upper end portion of the substrate with the longer direction of Elastic base layer roller 1 as a vertical direction, the elastic base layer roller was dipped in Coating-layer forming coating material 1 at a speed of 800 mm/min until the upper end of the elastic layer sank. After termination for 10 seconds, it was pulled up. An initial coating speed upon pulling up was 500 mm/min and a final coating speed was 400 mm/min. The coating speed was changed linearly with respect to the position. After air drying for 5 minutes in an environment of the temperature of 22° C. and relative humidity of 50%, the roller was dried/baked for 1 hour and 30 minutes in an oven of 150° C. to obtain a roller having, on the elastic layer thereof, a coating layer. The resulting roller will be called "Conductive layer roller 1".

In a manner similar to that employed for the formation of Conductive layer roller 1 except that a combination of the elastic base layer roller and the coating-layer forming coating material was changed as shown in Table 8, Conductive layer rollers 2 to 50 were obtained.

[Formation of Insulating Part]

Conductive layer roller 1 was dip coated with Insulating part coating material 1 to form an insulating part on the roller. While holding an upper end portion of the substrate with the longer direction of Conductive layer roller 1 as a vertical direction, the roller was dipped in Insulating part coating material 1 at a speed of 800 mm/min until the upper end of the elastic layer sank. After termination for 10 seconds, it was pulled up. A coating speed upon pulling up was fixed at 500 mm/min. After air drying for 5 minutes in an environment of the temperature of 22° C. and relative humidity of 50%, the roller was dried for 40 minutes in an oven of 60° C. and then cooled for one hour in an environment of the temperature of 22° C. and relative humidity of 50% to obtain an electrophotographic member before curing.

Next, the electrophotographic member before curing was exposed to ultraviolet rays in an atmospheric environment and a film of an insulating part coating material was cured. The electrophotographic member before curing was held by a jig capable of performing roller rotation in a circumferential direction and the surrounding environment was adjusted to an atmospheric environment of the temperature of 22° C. and 1 atmospheric pressure. While the electrophotographic member before curing was rotated in a circumferential direction under the above-described state, the electrophotographic member before curing was exposed to ultraviolet rays from a high-pressure mercury lamp ("Handy type UV curing device", trade name; product of Mario Network) so that the entire surface of the electrophotographic member was exposed uniformly. Exposure was performed for 120 seconds by rotating the roller twice per second so as to give an integral light of 10000 mJ/cm$^2$. After exposure, the roller was cooled for one hour in an environment of temperature of 22° C. and relative humidity of 50% to obtain an electrophotographic member of Example 1.

[Image Evaluation Method]

Images obtained using the electrophotographic members were all left for 12 hours in a high-temperature and high-humidity environment of the temperature of 30° C. and relative humidity of 80% and then evaluated in the same environment.

<Remodeling of Electrophotographic Process Cartridge>

A laser printer ("M553dn", trade name; product of Hewlett Packard) was provided. The process cartridge for magenta in the printer was remodeled and used for evaluation. Remodeling was performed by removing a drive gear from a toner supply roller of the process cartridge and changing the constitution of the toner supply roller to allow it to rotate following the electrophotographic member. An image was formed using the resulting remodeled process cartridge equipped with the electrophotographic member and was used for evaluation.

<Initial Image Output and Measurement of Image Density>

The remodeled process cartridge equipped with the electrophotographic member was loaded in the printer and a magenta solid image was output.

The initial image density of the magenta solid image obtained by image output was measured using a spectrophotometer ("X-rite", trade name; product of Videojet X-rite). The image density was measured at five points selected on the image at random and an average of them was used as a measurement value.

<Evaluation of Durability>

Next, the above-described remodeled cartridge was fabricated again and loaded in the printer. By using the resulting printer, an endurance test was performed by outputting a pattern of repeatedly drawing 2-dot width horizontal lines with a 98-dot pitch on two sheets at an interval of one second and totally on 15000 sheets. After the endurance test, image output was performed again as in the initial image output. The results were evaluated based on the following criteria. The results are shown in Table 15.

Rank 1: difference in image density between before and after the endurance test was less than 0.1.

Rank 2: difference in image density between before and after the endurance test was 0.1 or more to less than 0.2.

Rank 3: difference in image density between before and after the endurance test was 0.2 or more to less than 0.3.

Rank 4: difference in image density between before and after the endurance test was 0.4 or more.

<Measurement of Time Constant of Residual Potential after Endurance Test>

The remodeled cartridge which had finished the image output after endurance test was taken out. A toner container and a cleaning container were dismounted and the electrophotographic member incorporated in the toner container was taken out. A developer supported on the surface of the electrophotographic member was blown off and removed by air. The time constant of the residual potential of each of the first region and the second region on the developer-removed outer surface of the electrophotographic member was measured.

The time constant of the residual potential was determined by corona charging the outer surface of the electrophotographic member by using a corona discharge device and measuring a time-dependent change of the residual potential. Described specifically, a time-dependent change of the residual potential on the first region or the second region on the outer surface of the electrophotographic member was measured by an electrostatic force microscope ("MODEL 1100TN", trade name; product of Trek Japan, which will also be used hereinafter as the electrostatic force microscope) and fitting it in the following formula (1).

First, the outer surface of the electrophotographic member was observed with an optical microscope ("VHX5000", trade name; product of Keyence) and presence of two or more regions on the outer surface was confirmed. Next, from the electrophotographic member, a thin section including the outer surface of the electrophotographic member was cut out using a cryomicrotome ("UC-6", trade name; product of Leica Microsystems). The thin section was cut out at a temperature of −150° C. so as to have a size of 100 μm×100 μm as the outer surface of the electrophotographic member, have a thickness of 1 μm based on the outer surface of the coating layer and include two or more regions on the outer surface of the electrophotographic member.

Next, a residual potential distribution was measured. The residual potential distribution was determined by corona charging the outer surface of the electrophotographic member on the thin section by a corona discharge device and measuring the residual potential on the outer surface by an electrostatic force microscope while scanning the thin section.

First, the thin section was placed on a smooth silicon wafer with a surface of it including the outer surface of the electrophotographic member up and was left to stand for 24 hours in an environment of a temperature of 22° C. and a relative humidity of 50%. Next, the silicon wafer having the thin section was set, in the same environment, on a high-precision XY stage loaded in the electrostatic force microscope. As a corona discharge device, that having a wire-grid electrode distance of 8 mm was used. The corona discharge device was placed at a position to give a distance of 2 mm between the grid electrode and the surface of the silicon wafer. Then, the silicon wafer was grounded and voltages of −5 kV and −0.5 kV were applied to the wire and the grid electrode, respectively, from an external power source. After the application was started, the thin section was scanned at a speed of 20 mm/sec in parallel to the surface of the silicon wafer by using the high-precision XY stage so that it passed just below the corona discharge device and thus, the outer surface of the electrophotographic member on the thin section was corona charged.

Then, by using the high-precision XY stage, the thin section was moved to just below a cantilever of the electrostatic force microscope. Next, by measuring the residual potential of the outer surface of the electrophotographic member corona charged while scanning using the high-precision XY stage, a residual potential distribution was measured. The following are measurement conditions.

Measurement environment: temperature of the temperature of 22° C. and relative humidity of 50%

Time from passage of a measurement point just below the corona discharge device to start of measurement: 60 seconds Cantilever: cantilever for Model 1100TH (Model number: Model 1100TNC-N, product of Trek Japan)

Gap between a surface to be measured and a tip of cantilever: 10 μm

Measurement range: 99 μm×99 μm

Measurement interval: 3 μm×3 μm

By studying the presence or absence of the residual potential in two or more regions on the thin section based on the residual potential distribution obtained by the above-described measurement, whether the region was a first region or a second region having conductivity higher than that of the first region was checked. More specifically, by regarding one of the two or more regions including a portion whose absolute value of the residual potential was less than 1V as the second region and another one including a portion whose absolute value of the residual potential was larger by 1V or more than the absolute value of the residual potential of the second region as the first region, their presence was confirmed.

Measurement positions were determined in the first region and the second region thus confirmed, respectively, and a time constant of the residual potential was measured. The measurement point of the first region determined was where the absolute value of the residual potential was largest in the first region found by the measurement of the residual potential distribution, while the measurement point of the second region was where the absolute value of the residual potential was smallest in the second region found by the measurement of the residual potential distribution.

The thin section used for the measurement of the residual potential distribution was placed on a smooth silicon wafer with the surface including the outer surface of the developing roller up and it was left to stand for 24 hours in an environment of a room temperature of 22° C. and a relative humidity (RH) of 50%.

Then, the silicon wafer having the thin section was set on a high-precision XY stage loaded in the electrostatic force microscope in the same environment. As a corona discharge device, that having a wire-grid electrode distance of 8 mm was used. The corona discharge device was placed at a position to give a distance of 2 mm between the grid electrode and the surface of the silicon wafer. Then, the silicon wafer was grounded and voltages of −5 kV and −0.5 kV were applied to the wire and the grid electrode, respectively, from an external power source. After the application was started, the thin section was scanned at a speed of 20 mm/sec in parallel to the surface of the silicon wafer by using the high-precision XY stage so that it passed just below the corona discharge device and thus, the thin section was corona charged.

Then, by using the high-precision XY stage, the measurement point of the electrical insulating part or conductive layer was moved to just below a cantilever of the electrostatic force microscope and a time-dependent change of the residual potential was measured. For the measurement, the electrostatic force microscope was used. The following are measurement conditions.

Measurement environment: temperature of 22° C. and relative humidity of 50%

Time from passage of a measurement point just below the corona discharge device to start of measurement: 15 seconds Cantilever: cantilever for Model 1100TH (Model number: Model 1100TNC-N, product of Trek Japan)

Gap between a surface to be measured and a tip of cantilever: 10 μm

Measurement frequency: 6.25 Hz

Measurement time: 1000 seconds

Based on the time-dependent change of a residual potential obtained by the above-described measurement, data were fit to the following formula (1) by the least-squares method to determine a time constant τ.

$$V0=V(t)\times\exp(-t/\tau) \quad (1)$$

t: elapsed time (sec) after a measurement point passes just below the corona discharge device V0: initial potential (potential at t=0 sec) (V)

V(t): residual potential (V) t seconds after the measurement point passes just below the corona discharge device τ: time constant (sec) of residual potential The time constant τ of the residual potential of the outer surface of the electrophotographic member was measured at 3 points in the longer direction×3 points in the circumferential direction thereof, that is, 9 points in total and an average value of them was used as a time constant of the residual potential of the first region or the second region. It is to be noted that when the measurement of the second region includes a measurement point whose residual potential was substantially 0 V at the measurement start time, that is, 15 seconds after corona charge, the time constant was set less than the average value of the time constant of the remaining measurement points. When the potential of all the measurement points at the measurement start time was substantially 0 V, the time constant was set below the measurement lower limit.

Examples 2 to 18 and Comparative Examples 1 to 24

In a manner similar to that of Example 1 except that the elastic base layer roller and the coating-layer forming coating material were changed as shown in Table 8, electrophotographic members of Examples 2 to 18 and Comparative Examples 1 to 24 were obtained.

The electrophotographic members obtained in Examples 2 to 18 and Comparative Examples 1 to 24 were evaluated as in Example 1. The results are shown in Table 15.

TABLE 8

| Example | Elastic base layer roller | Coating-layer forming coating material | Insulating part material |
|---|---|---|---|
| Example 1 | Elastic base layer roller 1 | Coating-layer forming coating material 1 | Insulating part material 1 |
| Example 2 | Elastic base layer roller 14 | Coating-layer forming coating material 1 | Insulating part material 1 |
| Example 3 | Elastic base layer roller 17 | Coating-layer forming coating material 1 | Insulating part material 1 |
| Example 4 | Elastic base layer roller 1 | Coating-layer forming coating material 2 | Insulating part material 1 |
| Example 5 | Elastic base layer roller 14 | Coating-layer forming coating material 2 | Insulating part material 1 |
| Example 6 | Elastic base layer roller 17 | Coating-layer forming coating material 2 | Insulating part material 1 |
| Example 7 | Elastic base layer roller 1 | Coating-layer forming coating material 3 | Insulating part material 1 |
| Example 8 | Elastic base layer roller 14 | Coating-layer forming coating material 3 | Insulating part material 1 |
| Example 9 | Elastic base layer roller 17 | Coating-layer forming coating material 3 | Insulating part material 1 |
| Example 10 | Elastic base layer roller 1 | Coating-layer forming coating material 6 | Insulating part material 1 |
| Example 11 | Elastic base layer roller 14 | Coating-layer forming coating material 6 | Insulating part material 1 |
| Example 12 | Elastic base layer roller 17 | Coating-layer forming coating material 6 | Insulating part material 1 |
| Example 13 | Elastic base layer roller 1 | Coating-layer forming coating material 7 | Insulating part material 1 |
| Example 14 | Elastic base layer roller 14 | Coating-layer forming coating material 7 | Insulating part material 1 |
| Example 15 | Elastic base layer roller 17 | Coating-layer forming coating material 7 | Insulating part material 1 |
| Example 16 | Elastic base layer roller 1 | Coating-layer forming coating material 8 | Insulating part material 1 |
| Example 17 | Elastic base layer roller 14 | Coating-layer forming coating material 8 | Insulating part material 1 |
| Example 18 | Elastic base layer roller 17 | Coating-layer forming coating material 8 | Insulating part material 1 |
| Comp. Ex. 1 | Elastic base layer roller 20 | Coating-layer forming coating material 1 | Insulating part material 1 |
| Comp. Ex. 2 | Elastic base layer roller 23 | Coating-layer forming coating material 1 | Insulating part material 1 |

TABLE 8-continued

| Example | Elastic base layer roller | Coating-layer forming coating material | Insulating part material |
|---|---|---|---|
| Comp. Ex. 3 | Elastic base layer roller 20 | Coating-layer forming coating material 2 | Insulating part material 1 |
| Comp. Ex. 4 | Elastic base layer roller 23 | Coating-layer forming coating material 2 | Insulating part material 1 |
| Comp. Ex. 5 | Elastic base layer roller 20 | Coating-layer forming coating material 3 | Insulating part material 1 |
| Comp. Ex. 6 | Elastic base layer roller 23 | Coating-layer forming coating material 3 | Insulating part material 1 |
| Comp. Ex. 7 | Elastic base layer roller 1 | Coating-layer forming coating material 4 | Insulating part material 1 |
| Comp. Ex. 8 | Elastic base layer roller 14 | Coating-layer forming coating material 4 | Insulating part material 1 |
| Comp. Ex. 9 | Elastic base layer roller 17 | Coating-layer forming coating material 4 | Insulating part material 1 |
| Comp. Ex. 10 | Elastic base layer roller 1 | Coating-layer forming coating material 5 | Insulating part material 1 |
| Comp. Ex. 11 | Elastic base layer roller 14 | Coating-layer forming coating material 5 | Insulating part material 1 |
| Comp. Ex. 12 | Elastic base layer roller 17 | Coating-layer forming coating material 5 | Insulating part material 1 |
| Comp. Ex. 13 | Elastic base layer roller 20 | Coating-layer forming coating material 6 | Insulating part material 1 |
| Comp. Ex. 14 | Elastic base layer roller 23 | Coating-layer forming coating material 6 | Insulating part material 1 |
| Comp. Ex. 15 | Elastic base layer roller 20 | Coating-layer forming coating material 7 | Insulating part material 1 |
| Comp. Ex. 16 | Elastic base layer roller 23 | Coating-layer forming coating material 7 | Insulating part material 1 |
| Comp. Ex. 17 | Elastic base layer roller 20 | Coating-layer forming coating material 8 | Insulating part material 1 |
| Comp. Ex. 18 | Elastic base layer roller 23 | Coating-layer forming coating material 8 | Insulating part material 1 |
| Comp. Ex. 19 | Elastic base layer roller 1 | Coating-layer forming coating material 9 | Insulating part material 1 |
| Comp. Ex. 20 | Elastic base layer roller 14 | Coating-layer forming coating material 9 | Insulating part material 1 |
| Comp. Ex. 21 | Elastic base layer roller 17 | Coating-layer forming coating material 9 | Insulating part material 1 |
| Comp. Ex. 22 | Elastic base layer roller 1 | Coating-layer forming coating material 10 | Insulating part material 1 |
| Comp. Ex. 23 | Elastic base layer roller 14 | Coating-layer forming coating material 10 | Insulating part material 1 |
| Comp. Ex. 24 | Elastic base layer roller 17 | Coating-layer forming coating material 10 | Insulating part material 1 |

Examples 19 to 34 and Comparative Examples 25 to 28

In a manner similar to that of Example 1 except that the elastic base layer roller was changed as shown in Table 9, electrophotographic members of Examples 19 to 34 and Comparative Examples 25 to 28 were obtained.

The electrophotographic members obtained in Examples 19 to 34 and Comparative Examples 25 to 28 were evaluated as in Example 1. The results are shown in Table 16.

TABLE 9

| Example | Elastic base layer roller | Coating-layer forming coating material | Insulating part material |
|---|---|---|---|
| Example 19 | Elastic base layer roller 2 | Coating-layer forming coating material 1 | Insulating part material 1 |
| Example 20 | Elastic base layer roller 3 | Coating-layer forming coating material 1 | Insulating part material 1 |
| Example 21 | Elastic base layer roller 4 | Coating-layer forming coating material 1 | Insulating part material 1 |
| Example 22 | Elastic base layer roller 5 | Coating-layer forming coating material 1 | Insulating part material 1 |
| Example 23 | Elastic base layer roller 6 | Coating-layer forming coating material 1 | Insulating part material 1 |
| Example 24 | Elastic base layer roller 7 | Coating-layer forming coating material 1 | Insulating part material 1 |
| Example 25 | Elastic base layer roller 8 | Coating-layer forming coating material 1 | Insulating part material 1 |
| Example 26 | Elastic base layer roller 9 | Coating-layer forming coating material 1 | Insulating part material 1 |
| Example 27 | Elastic base layer roller 10 | Coating-layer forming coating material 1 | Insulating part material 1 |
| Example 28 | Elastic base layer roller 11 | Coating-layer forming coating material 1 | Insulating part material 1 |
| Example 29 | Elastic base layer roller 12 | Coating-layer forming coating material 1 | Insulating part material 1 |
| Example 30 | Elastic base layer roller 13 | Coating-layer forming coating material 1 | Insulating part material 1 |
| Example 31 | Elastic base layer roller 15 | Coating-layer forming coating material 1 | Insulating part material 1 |
| Example 32 | Elastic base layer roller 16 | Coating-layer forming coating material 1 | Insulating part material 1 |
| Example 33 | Elastic base layer roller 18 | Coating-layer forming coating material 1 | Insulating part material 1 |
| Example 34 | Elastic base layer roller 19 | Coating-layer forming coating material 1 | Insulating part material 1 |

TABLE 9-continued

| Example | Elastic base layer roller | Coating-layer forming coating material | Insulating part material |
|---|---|---|---|
| Comp. Ex. 25 | Elastic base layer roller 21 | Coating-layer forming coating material 1 | Insulating part material 1 |
| Comp. Ex. 26 | Elastic base layer roller 22 | Coating-layer forming coating material 1 | Insulating part material 1 |
| Comp. Ex. 27 | Elastic base layer roller 24 | Coating-layer forming coating material 1 | Insulating part material 1 |
| Comp. Ex. 28 | Elastic base layer roller 25 | Coating-layer forming coating material 1 | Insulating part material 1 |

Examples 35 to 50

In a manner similar to that of Example 1 except that the elastic base layer roller and the coating-layer forming coating material were changed as shown in Table 10, electrophotographic members of Examples 35 to 50 were obtained.

The electrophotographic members of Examples 35 to 50 were evaluated as in Example 1. The results are shown in Table 17.

TABLE 10

| Example | Elastic base layer roller | Coating-layer forming coating material | Insulating part material |
|---|---|---|---|
| Example 35 | Elastic base layer roller 1 | Coating-layer forming coating material 11 | Insulating part material 1 |
| Example 36 | Elastic base layer roller 1 | Coating-layer forming coating material 12 | Insulating part material 1 |
| Example 37 | Elastic base layer roller 1 | Coating-layer forming coating material 13 | Insulating part material 1 |
| Example 38 | Elastic base layer roller 1 | Coating-layer forming coating material 14 | Insulating part material 1 |
| Example 39 | Elastic base layer roller 1 | Coating-layer forming coating material 15 | Insulating part material 1 |
| Example 40 | Elastic base layer roller 1 | Coating-layer forming coating material 16 | Insulating part material 1 |
| Example 41 | Elastic base layer roller 1 | Coating-layer forming coating material 17 | Insulating part material 1 |
| Example 42 | Elastic base layer roller 1 | Coating-layer forming coating material 18 | Insulating part material 1 |
| Example 43 | Elastic base layer roller 1 | Coating-layer forming coating material 19 | Insulating part material 1 |
| Example 44 | Elastic base layer roller 1 | Coating-layer forming coating material 20 | Insulating part material 1 |
| Example 45 | Elastic base layer roller 1 | Coating-layer forming coating material 21 | Insulating part material 1 |
| Example 46 | Elastic base layer roller 1 | Coating-layer forming coating material 22 | Insulating part material 1 |
| Example 47 | Elastic base layer roller 1 | Coating-layer forming coating material 23 | Insulating part material 1 |
| Example 48 | Elastic base layer roller 1 | Coating-layer forming coating material 24 | Insulating part material 1 |
| Example 49 | Elastic base layer roller 1 | Coating-layer forming coating material 25 | Insulating part material 1 |
| Example 50 | Elastic base layer roller 1 | Coating-layer forming coating material 26 | Insulating part material 1 |

Examples 51 to 70

In a manner similar to that of Example 1 except that the elastic base layer roller and the coating-layer forming coating material were changed as shown in Table 11, electrophotographic members of Examples 51 to 70 were obtained.

The electrophotographic members of Examples 51 to 70 were evaluated as in Example 1. The results are shown in Table 18.

TABLE 11

| Example | Elastic base layer roller | Coating-layer forming coating material | Insulating part material |
|---|---|---|---|
| Example 51 | Elastic base layer roller 1 | Coating-layer forming coating material 1 | Insulating part material 2 |
| Example 52 | Elastic base layer roller 1 | Coating-layer forming coating material 1 | Insulating part material 3 |
| Example 53 | Elastic base layer roller 1 | Coating-layer forming coating material 1 | Insulating part material 4 |
| Example 54 | Elastic base layer roller 1 | Coating-layer forming coating material 6 | Insulating part material 2 |
| Example 55 | Elastic base layer roller 1 | Coating-layer forming coating material 6 | Insulating part material 3 |
| Example 56 | Elastic base layer roller 1 | Coating-layer forming coating material 6 | Insulating part material 4 |
| Example 57 | Elastic base layer roller 1 | Coating-layer forming coating material 11 | Insulating part material 2 |
| Example 58 | Elastic base layer roller 1 | Coating-layer forming coating material 11 | Insulating part material 3 |
| Example 59 | Elastic base layer roller 1 | Coating-layer forming coating material 11 | Insulating part material 4 |
| Example 60 | Elastic base layer roller 1 | Coating-layer forming coating material 12 | Insulating part material 2 |
| Example 61 | Elastic base layer roller 1 | Coating-layer forming coating material 12 | Insulating part material 3 |
| Example 62 | Elastic base layer roller 1 | Coating-layer forming coating material 12 | Insulating part material 4 |
| Example 63 | Elastic base layer roller 1 | Coating-layer forming coating material 1 | Insulating part material 5 |
| Example 64 | Elastic base layer roller 1 | Coating-layer forming coating material 1 | Insulating part material 6 |
| Example 65 | Elastic base layer roller 1 | Coating-layer forming coating material 1 | Insulating part material 7 |
| Example 66 | Elastic base layer roller 1 | Coating-layer forming coating material 1 | Insulating part material 8 |

TABLE 11-continued

| Example | Elastic base layer roller | Coating-layer forming coating material | Insulating part material |
|---|---|---|---|
| Example 67 | Elastic base layer roller 1 | Coating-layer forming coating material 1 | Insulating part material 5 |
| Example 68 | Elastic base layer roller 1 | Coating-layer forming coating material 1 | Insulating part material 6 |
| Example 69 | Elastic base layer roller 1 | Coating-layer forming coating material 1 | Insulating part material 7 |
| Example 70 | Elastic base layer roller 1 | Coating-layer forming coating material 1 | Insulating part material 8 |

Examples 71 to 76

[Preparation of Surface Layer Coating Material]

Polycarbonate polyol ("Kuraray Polyol C2090", trade name; product of Kuraray) was used as Polyol 3.

The following materials were mixed in a container.

| | |
|---|---|
| Polyol 1 | 30.0 g |
| Polyol 2 | 30.0 g |
| Polyol 3 | 60.0 g |
| Isocyanate 1 | 36.9 g |
| Modified silicone 1 | 1.6 g |
| Carbon black 2 | 20.4 g |
| Solvent 1 | 886.4 g |

In a sand mill filled 80 mass % with glass beads having a particle size of 1.5 mm, the resulting mixture was dispersed for one hour at a peripheral speed of 4 m/s while keeping the temperature at 20° C. or more to less than 26° C. The resulting dispersion was filtered through a #100 nylon mesh to obtain Surface layer coating material 1. In a manner similar to that used for Surface layer coating material 1 except the composition was changed as shown in the following table, Surface layer coating materials 2 to 5 were prepared. They are shown collectively in Table 12.

TABLE 12

| Surface layer forming coating material No. | Polyol 1 (g) | Polyol 2 (g) | Polyol 3 (g) | Isocyanate 1 (g) | Modified silicone 1 (g) | Carbon black 2 (g) | Solvent 1 (g) |
|---|---|---|---|---|---|---|---|
| 1 | 30 | 30 | 60 | 36.9 | 1.6 | 20.4 | 886.4 |
| 2 | 30 | 30 | 60 | 36.9 | 1.6 | 17.7 | 886.4 |
| 3 | 30 | 30 | 90 | 41.8 | 1.6 | 24.9 | 1084 |
| 4 | 30 | 30 | 30 | 15.9 | 1.6 | 15.9 | 689.1 |
| 5 | 30 | 30 | 30 | 69.3 | 1.6 | 21 | 700.4 |

[Formation of Surface Layer]

Conductive layer roller 1 was provided with a surface layer by dip coating of Surface layer coating material 1. While holding the upper end portion of the substrate with the longer direction of Conductive layer roller 1 as a vertical direction, Conductive layer roller 1 was dipped in Surface layer coating material 1 at a speed of 800 mm/min until the upper end of the elastic layer sank. After termination for 10 seconds, it was pulled up. An initial coating speed upon pulling up was 300 mm/min and a final coating speed was 250 mm/min. The coating speed was changed linearly with respect to the position. After air drying for 5 minutes in an environment of 22° C. and 50% Rh, the roller was dried/baked for 1 hour and 30 minutes in an oven of 150° C. to obtain a roller having a surface layer on the coating layer. On the surface of the resulting roller, phase separation of the surface layer occurred as shown in FIG. 4 and both the electro-conductive region having Carbon black 2 therein and the insulating region having no Carbon black 2 therein existed. The resulting roller is designated as an electrophotographic member of Example 71.

In a manner similar to that used in Example 71 except that Surface layer coating material 1 was changed to Surface layer coating materials 2 to 4, electrophotographic members of Examples 72 to 74 were prepared, respectively.

In a manner similar to that used in Example 71 except that Surface layer coating material 1 of Example 71 was changed to Surface layer coating material 5, Surface layer coating material 5 was applied to the electro-conductive layer roller to obtain Surface layer roller 1. No phase separation occurred in the surface layer of Surface layer roller 1 and Carbon black 2 was dispersed uniformly all over the surface layer. Next, an insulating part was formed on Surface layer roller 1 as in Example 1. In the roller thus obtained, the surface layer had, on the surface thereof, an insulating part similar to that of Example 1 as shown in FIG. 5. The resulting roller will be called "the electrophotographic member of Example 75".

The materials shown in Table 13 were mixed according to the mixing ratio shown in the same table and the resulting mixture was dispersed for one hour at a peripheral speed of 4 m/s in a sand mill filled 80 mass % with glass beads having a particle size of 1.5 mm while keeping the temperature at 20° C. or more to less than 26° C. The resulting dispersion was filtered through a #100 nylon mesh to obtain Coating-layer forming coating material 27.

TABLE 13

| | Mixed amount (g) |
|---|---|
| Ether polyol ("Adeka polyether PR-3007", trade name; product of Adeka) | 70 |
| Insulating polyester resin ("VYLON 103", trade name; product of Toyobo) | 15 |
| Isocyanate ("Millionate MR-400", trade name; product of TOSOH) | 15 |
| Carbon black ("Toka Black #7360SB", trade name; product of Tokai Carbon) | 15 |
| Solvent 1 | 300 |

Coating-layer forming coating material 27 was applied to Elastic base layer roller 1 which was stood vertically while rotating the roller at 1500 rpm and descending a spray gun at 30 mm/s in an environment of 22° C. and 50% Rh. A distance between the spray gun and the surface of Elastic base layer roller 1 was set at 50 mm. After the coated product having a film of Coating-layer forming coating material 27 was put in an oven and heated at a temperature of 80° C. for 15 minutes, it was heated for further two hours in the oven set at 140° C. to cure the film and form a 15.0-μm thick conductive urethane resin layer on the elastic base layer roller. In such a manner, an electrophotographic member having, on the surface thereof, a coating layer having an electrical insulating polyester region in the matrix surface of the electro-conductive urethane resin layer as shown in FIG. 3 was obtained. The resulting product will hereinafter be called "the electrophotographic member of Example 76".

Comparative Examples 29 and 30

Conductive layer roller 1 of Example 1 but not having an insulating part was used as is as an electrophotographic member. It will hereinafter be called "the electrophotographic member of Comparative Example 29".

In a manner similar to that used for manufacture of Elastic layer forming mold 1 except that plating was not given, Elastic layer forming mold 14 was manufactured. In a manner similar to that of Example 1 except for the use of Elastic layer forming mold 14, an elastic layer, a coating layer and an insulating part were formed to obtain an electrophotographic member similar to that of Example 1 but not having the first protrusion. The electrophotographic member thus obtained will be called "the electrophotographic member of Comparative Example 30".

Electrophotographic members obtained in Examples 71 to 76 and Comparative Examples 29 and 30 were evaluated as in Example 1. The results are shown in Table 21.

[Common Physical Properties]

The height and width of the first protrusion, density of the protrusion and elastic modulus of the elastic layer, of each of the elastic base layer rollers, are collectively shown in Table 14.

TABLE 14

| Roller | Mold | Material | Height of protrusion μm | Width of protrusion μm | Density of protrusion piece/mm$^2$ | Elastic modulus MPa |
|---|---|---|---|---|---|---|
| Elastic base layer roller 1 | Elastic layer forming mold 1 | Elastic layer forming material 1 | 7 | 30 | 6 | 1.0 |
| Elastic base layer roller 2 | Elastic layer forming mold 2 | Elastic layer forming material 1 | 7 | 30 | 1 | 1.0 |
| Elastic base layer roller 3 | Elastic layer forming mold 3 | Elastic layer forming material 1 | 7 | 30 | 20 | 1.0 |
| Elastic base layer roller 4 | Elastic layer forming mold 4 | Elastic layer forming material 1 | 7 | 15 | 6 | 1.0 |
| Elastic base layer roller 5 | Elastic layer forming mold 5 | Elastic layer forming material 1 | 7 | 60 | 6 | 1.0 |
| Elastic base layer roller 6 | Elastic layer forming mold 6 | Elastic layer forming material 1 | 3 | 5 | 20 | 1.0 |
| Elastic base layer roller 7 | Elastic layer forming mold 7 | Elastic layer forming material 1 | 3 | 5 | 100 | 1.0 |
| Elastic base layer roller 8 | Elastic layer forming mold 8 | Elastic layer forming material 1 | 3 | 15 | 20 | 1.0 |
| Elastic base layer roller 9 | Elastic layer forming mold 9 | Elastic layer forming material 1 | 3 | 30 | 6 | 1.0 |
| Elastic base layer roller 10 | Elastic layer forming mold 10 | Elastic layer forming material 1 | 15 | 30 | 6 | 1.0 |
| Elastic base layer roller 11 | Elastic layer forming mold 11 | Elastic layer forming material 1 | 15 | 60 | 5 | 1.0 |
| Elastic base layer roller 12 | Elastic layer forming mold 12 | Elastic layer forming material 1 | 50 | 300 | 1 | 1.0 |
| Elastic base layer roller 13 | Elastic layer forming mold 13 | Elastic layer forming material 1 | 50 | 300 | 3 | 1.0 |
| Elastic base layer roller 14 | Elastic layer forming mold 1 | Elastic layer forming material 2 | 7 | 30 | 6 | 0.5 |
| Elastic base layer roller 15 | Elastic layer forming mold 8 | Elastic layer forming material 2 | 3 | 15 | 20 | 0.5 |
| Elastic base layer roller 16 | Elastic layer forming mold 11 | Elastic layer forming material 2 | 15 | 60 | 5 | 0.5 |
| Elastic base layer roller 17 | Elastic layer forming mold 1 | Elastic layer forming material 3 | 7 | 30 | 6 | 3.0 |
| Elastic base layer roller 18 | Elastic layer forming mold 8 | Elastic layer forming material 3 | 3 | 15 | 20 | 3.0 |
| Elastic base layer roller 19 | Elastic layer forming mold 11 | Elastic layer forming material 3 | 15 | 60 | 5 | 3.0 |
| Elastic base layer roller 20 | Elastic layer forming mold 1 | Elastic layer forming material 4 | 7 | 30 | 6 | 0.3 |
| Elastic base layer roller 21 | Elastic layer forming mold 8 | Elastic layer forming material 4 | 3 | 15 | 20 | 0.3 |
| Elastic base layer roller 22 | Elastic layer forming mold 11 | Elastic layer forming material 4 | 15 | 60 | 5 | 0.3 |
| Elastic base layer roller 23 | Elastic layer forming mold 1 | Elastic layer forming material 5 | 7 | 30 | 6 | 5.0 |
| Elastic base layer roller 24 | Elastic layer forming mold 8 | Elastic layer forming material 5 | 3 | 15 | 20 | 5.0 |
| Elastic base layer roller 25 | Elastic layer forming mold 11 | Elastic layer forming material 5 | 15 | 60 | 5 | 5.0 |

The elastic modulus, volume resistivity and film thickness of the coating layers prepared using the coating-layer forming coating materials, respectively, are collectively shown in Table 15.

TABLE 15

| Material | Elastic modulus Mpa | Volume resistivity Ω · cm | Film thickness μm |
|---|---|---|---|
| Coating-layer forming coating material 1 | 20 | 1.0E+07 | 12 |
| Coating-layer forming coating material 2 | 5 | 1.0E+07 | 12 |
| Coating-layer forming coating material 3 | 100 | 1.0E+07 | 12 |
| Coating-layer forming coating material 4 | 3 | 1.0E+07 | 12 |
| Coating-layer forming coating material 5 | 500 | 1.0E+07 | 12 |
| Coating-layer forming coating material 6 | 20 | 1.0E+05 | 12 |
| Coating-layer forming coating material 7 | 5 | 1.0E+05 | 12 |
| Coating-layer forming coating material 8 | 100 | 1.0E+05 | 12 |
| Coating-layer forming coating material 9 | 3 | 1.0E+05 | 12 |
| Coating-layer forming coating material 10 | 500 | 1.0E+05 | 12 |
| Coating-layer forming coating material 11 | 20 | 1.0E+11 | 12 |
| Coating-layer forming coating material 12 | 20 | 2.0E+11 | 12 |
| Coating-layer forming coating material 13 | 20 | 1.0E+07 | 3 |
| Coating-layer forming coating material 14 | 20 | 1.0E+07 | 7 |
| Coating-layer forming coating material 15 | 20 | 1.0E+07 | 20 |
| Coating-layer forming coating material 16 | 20 | 1.0E+07 | 30 |
| Coating-layer forming coating material 17 | 20 | 1.0E+07 | 12 |
| Coating-layer forming coating material 18 | 20 | 1.0E+07 | 3 |
| Coating-layer forming coating material 19 | 20 | 1.0E+07 | 7 |
| Coating-layer forming coating material 20 | 20 | 1.0E+07 | 20 |
| Coating-layer forming coating material 21 | 20 | 1.0E+07 | 30 |
| Coating-layer forming coating material 22 | 20 | 1.0E+07 | 12 |
| Coating-layer forming coating material 23 | 20 | 1.0E+07 | 3 |

TABLE 15-continued

| Material | Elastic modulus Mpa | Volume resistivity Ω · cm | Film thickness μm |
|---|---|---|---|
| Coating-layer forming coating material 24 | 20 | 1.0E+07 | 7 |
| Coating-layer forming coating material 25 | 20 | 1.0E+07 | 20 |
| Coating-layer forming coating material 26 | 20 | 1.0E+07 | 30 |

The elastic modulus and volume resistivity of the insulating parts prepared using the insulating members, respectively, are collectively shown in the following Table 16.

TABLE 16

| Material | Volume resistivity Ω · cm | Elastic modulus Gpa |
|---|---|---|
| Insulating part material 1 | 1.00E+15 | 2.1 |
| Insulating part material 2 | 1.00E+13 | 2 |
| Insulating part material 3 | 1.00E+17 | 2.2 |
| Insulating part material 4 | 1.00E+12 | 1.9 |
| Insulating part material 5 | 1.00E+15 | 2.1 |
| Insulating part material 6 | 1.00E+15 | 2.1 |
| Insulating part material 7 | 1.00E+15 | 2.1 |
| Insulating part material 8 | 1.00E+15 | 2.1 |

Evaluation Results

Examples 1 to 18 and Comparative Examples 1 to 24

Evaluation results of Examples 1 to 18 and Comparative Examples 1 to 24 are shown collectively in Table 17.

TABLE 17

| Example | Elastic modulus of Mpa | Elastic modulus of Mpa | Elastic modulus of Gpa | Time constant First region (sec) | Time constant Second region (sec) | Image density Before endurance | Image density After endurance | Evaluation Rank |
|---|---|---|---|---|---|---|---|---|
| Example 1 | 1 | 20 | 2.1 | 6521.8 | Below measurement lower limit | 1.29 | 1.26 | 1 |
| Example 2 | 0.5 | 20 | 2.1 | 11480 | Below measurement lower limit | 1.29 | 1.26 | 1 |
| Example 3 | 3 | 20 | 2.1 | 10902.3 | Below measurement lower limit | 1.31 | 1.24 | 1 |
| Example 4 | 1 | 5 | 2.1 | 6424.8 | Below measurement lower limit | 1.28 | 1.26 | 1 |
| Example 5 | 0.5 | 5 | 2.1 | 7273.7 | Below measurement lower limit | 1.31 | 1.23 | 1 |
| Example 6 | 3 | 5 | 2.1 | 8236.9 | Below measurement lower limit | 1.28 | 1.23 | 1 |
| Example 7 | 1 | 100 | 2.1 | 10056.3 | Below measurement lower limit | 1.3 | 1.23 | 1 |
| Example 8 | 0.5 | 100 | 2.1 | 9117 | Below measurement lower limit | 1.28 | 1.26 | 1 |
| Example 9 | 3 | 100 | 2.1 | 7126.9 | Below measurement lower limit | 1.29 | 1.24 | 1 |
| Example 10 | 1 | 20 | 2.1 | 10792.3 | Below measurement lower limit | 1.3 | 1.26 | 1 |
| Example 11 | 0.5 | 20 | 2.1 | 7791.5 | Below measurement lower limit | 1.29 | 1.23 | 1 |
| Example 12 | 3 | 20 | 2.1 | 9965.3 | Below measurement lower limit | 1.28 | 1.26 | 1 |
| Example 13 | 1 | 5 | 2.1 | 7504.6 | Below measurement lower limit | 1.31 | 1.24 | 1 |
| Example 14 | 0.5 | 5 | 2.1 | 10357.6 | Below measurement lower limit | 1.31 | 1.23 | 1 |
| Example 15 | 3 | 5 | 2.1 | 10581.3 | Below measurement lower limit | 1.28 | 1.23 | 1 |
| Example 16 | 1 | 100 | 2.1 | 11817.7 | Below measurement lower limit | 1.29 | 1.23 | 1 |
| Example 17 | 0.5 | 100 | 2.1 | 11132.2 | Below measurement lower limit | 1.29 | 1.23 | 1 |
| Example 18 | 3 | 100 | 2.1 | 9644.8 | Below measurement lower limit | 1.31 | 1.25 | 1 |
| Comp. Ex. 1 | 0.3 | 20 | 2.1 | 1.6 | Below measurement lower limit | 1.28 | 0.82 | 4 |
| Comp. Ex. 2 | 5 | 20 | 2.1 | 1.3 | Below measurement lower limit | 1.29 | 0.8 | 4 |
| Comp. Ex. 3 | 0.3 | 5 | 2.1 | 1.8 | Below measurement lower limit | 1.3 | 0.83 | 4 |
| Comp. Ex. 4 | 5 | 5 | 2.1 | 1.7 | Below measurement lower limit | 1.31 | 0.81 | 4 |
| Comp. Ex. 5 | 0.3 | 100 | 2.1 | 1.4 | Below measurement lower limit | 1.28 | 0.81 | 4 |
| Comp. Ex. 6 | 5 | 100 | 2.1 | 1.1 | Below measurement lower limit | 1.29 | 0.8 | 4 |
| Comp. Ex. 7 | 1 | 3 | 2.1 | 1.6 | Below measurement lower limit | 1.28 | 0.8 | 4 |
| Comp. Ex. 8 | 0.5 | 3 | 2.1 | 1.1 | Below measurement lower limit | 1.3 | 0.81 | 4 |
| Comp. Ex. 9 | 3 | 3 | 2.1 | 1.1 | Below measurement lower limit | 1.3 | 0.83 | 4 |
| Comp. Ex. 10 | 1 | 500 | 2.1 | 1 | Below measurement lower limit | 1.29 | 0.82 | 4 |
| Comp. Ex. 11 | 0.5 | 500 | 2.1 | 1.1 | Below measurement lower limit | 1.31 | 0.83 | 4 |
| Comp. Ex. 12 | 3 | 500 | 2.1 | 1.2 | Below measurement lower limit | 1.29 | 0.8 | 4 |
| Comp. Ex. 13 | 0.3 | 20 | 2.1 | 1 | Below measurement lower limit | 1.31 | 0.81 | 4 |
| Comp. Ex. 14 | 5 | 20 | 2.1 | 1 | Below measurement lower limit | 1.29 | 0.83 | 4 |
| Comp. Ex. 15 | 0.3 | 5 | 2.1 | 1.7 | Below measurement lower limit | 1.28 | 0.81 | 4 |

TABLE 17-continued

| Example | Elastic modulus of Mpa | Elastic modulus of Mpa | Elastic modulus of Gpa | Time constant First region (sec) | Time constant Second region (sec) | Image density Before endurance | Image density After endurance | Evaluation Rank |
|---|---|---|---|---|---|---|---|---|
| Comp. Ex. 16 | 5 | 5 | 2.1 | 1.9 | Below measurement lower limit | 1.31 | 0.81 | 4 |
| Comp. Ex. 17 | 0.3 | 100 | 2.1 | 1 | Below measurement lower limit | 1.31 | 0.82 | 4 |
| Comp. Ex. 18 | 5 | 100 | 2.1 | 1.8 | Below measurement lower limit | 1.28 | 0.81 | 4 |
| Comp. Ex. 19 | 1 | 3 | 2.1 | 1.2 | Below measurement lower limit | 1.29 | 0.83 | 4 |
| Comp. Ex. 20 | 0.5 | 3 | 2.1 | 1.4 | Below measurement lower limit | 1.31 | 0.81 | 4 |
| Comp. Ex. 21 | 3 | 3 | 2.1 | 1.3 | Below measurement lower limit | 1.31 | 0.83 | 4 |
| Comp. Ex. 22 | 1 | 500 | 2.1 | 1.8 | Below measurement lower limit | 1.29 | 0.83 | 4 |
| Comp. Ex. 23 | 0.5 | 500 | 2.1 | 1.3 | Below measurement lower limit | 1.28 | 0.81 | 4 |
| Comp. Ex. 24 | 3 | 500 | 2.1 | 1.4 | Below measurement lower limit | 1.29 | 0.82 | 4 |

As shown in Table 17, electrophotographic members of the present constitution having an elastic layer whose elastic modulus is 0.5 MPa or more to 3.0 MPa or less and a coating layer whose elastic modulus is 5.0 MPa or more to 100.0 MP or less exhibit a small image density difference between before and after an endurance test and are therefore considerably useful as an electrophotographic member. When these elastic moduli are out of the above-described ranges, on the other hand, an image density difference between before and after an endurance test is very large.

Examples 19 to 34 and Comparative Examples 25 to 28

Evaluation results of Examples 19 to 34 and Comparative Examples 25 to 28 are collectively shown in Table 18.

TABLE 18

| Example | Elastic layer Elastic modulus MPa | Coating layer Elastic modulus MPa | Insulating part Elastic modulus Gpa | First protrusion Height μm | First protrusion Width μm | First protrusion Density piece/mm | Time constant First region (sec) | Time constant Second region (sec) | Image density Before endurance | Image density After endurance | Evaluation Rank |
|---|---|---|---|---|---|---|---|---|---|---|---|
| Example 1 | 1.0 | 20 | 2.1 | 7 | 30 | 6 | 6521.8 | Below measurement lower limit | 1.29 | 1.26 | 1 |
| Example 19 | 1.0 | 20 | 2.1 | 7 | 30 | 1 | 9267.7 | Below measurement lower limit | 1.31 | 1.28 | 1 |
| Example 20 | 1.0 | 20 | 2.1 | 7 | 30 | 20 | 8513.1 | Below measurement lower limit | 1.28 | 1.25 | 1 |
| Example 21 | 1.0 | 20 | 2.1 | 7 | 15 | 6 | 10280.1 | Below measurement lower limit | 1.29 | 1.25 | 1 |
| Example 22 | 1.0 | 20 | 2.1 | 7 | 60 | 6 | 8085.9 | Below measurement lower limit | 1.3 | 1.26 | 1 |
| Example 23 | 1.0 | 20 | 2.1 | 3 | 5 | 20 | 9431.2 | Below measurement lower limit | 1.31 | 1.28 | 1 |
| Example 24 | 1.0 | 20 | 2.1 | 3 | 5 | 100 | 8171.4 | Below measurement lower limit | 1.28 | 1.24 | 1 |
| Example 25 | 1.0 | 20 | 2.1 | 3 | 15 | 20 | 9089.8 | Below measurement lower limit | 1.3 | 1.27 | 1 |
| Example 26 | 1.0 | 20 | 2.1 | 3 | 30 | 6 | 11613 | Below measurement lower limit | 1.31 | 1.27 | 1 |
| Example 27 | 1.0 | 20 | 2.1 | 15 | 30 | 6 | 8197.1 | Below measurement lower limit | 1.28 | 1.25 | 1 |
| Example 28 | 1.0 | 20 | 2.1 | 15 | 60 | 5 | 7988.2 | Below measurement lower limit | 1.29 | 1.26 | 1 |
| Example 29 | 1.0 | 20 | 2.1 | 50 | 300 | 1 | 11791.2 | Below measurement lower limit | 1.28 | 1.25 | 1 |
| Example 30 | 1.0 | 20 | 2.1 | 50 | 300 | 3 | 6272.6 | Below measurement lower limit | 1.29 | 1.26 | 1 |
| Example 31 | 0.5 | 20 | 2.1 | 3 | 15 | 20 | 7570.3 | Below measurement lower limit | 1.31 | 1.27 | 1 |
| Example 32 | 0.5 | 20 | 2.1 | 15 | 60 | 5 | 9858.4 | Below measurement lower limit | 1.3 | 1.27 | 1 |
| Example 33 | 3.0 | 20 | 2.1 | 3 | 15 | 20 | 7628.8 | Below measurement lower limit | 1.31 | 1.28 | 1 |
| Example 34 | 3.0 | 20 | 2.1 | 15 | 60 | 5 | 10241.1 | Below measurement lower limit | 1.28 | 1.24 | 1 |
| Comp. Ex. 25 | 0.3 | 20 | 2.1 | 3 | 15 | 20 | 1.8 | Below measurement lower limit | 1.28 | 0.77 | 4 |
| Comp. Ex. 26 | 0.3 | 20 | 2.1 | 15 | 60 | 5 | 1.5 | Below measurement lower limit | 1.28 | 0.78 | 4 |
| Comp. Ex. 27 | 5.0 | 20 | 2.1 | 3 | 15 | 20 | 1.8 | Below measurement lower limit | 1.31 | 0.81 | 4 |
| Comp. Ex. 28 | 5.0 | 20 | 2.1 | 15 | 60 | 5 | 1.8 | Below measurement lower limit | 1.3 | 0.79 | 4 |

As shown in Table 18, electrophotographic members of the present constitution having an elastic layer whose elastic modulus is 0.5 MPa or more to 3.0 MPa or less and a coating layer whose elastic modulus is 5.0 MPa or more to 100.0 MP or less exhibit a small image density difference between before and after an endurance test and are therefore considerably useful as an electrophotographic member. Irrespective of the size or density of the first protrusions provided on the elastic layer, they are useful. An elastic modulus out of the above-described ranges leads to a very large image density difference between before and after an endurance test.

Examples 35 to 50

Evaluation results of Examples 35 to 50 are collectively shown in Table 19.

TABLE 19

| Example | Elastic modulus of elastic layer Mpa | Elastic modulus of coating layer Mpa | Elastic modulus of insulating part Gpa | Resistivity of coating layer Ω · cm | Film thickness of coating layer μm | Correlation of protrusion | Time constant First region (sec) | Time constant Second region (sec) | Image density Before endurance | Image density After endurance | Evaluation Rank |
|---|---|---|---|---|---|---|---|---|---|---|---|
| Example 1 | 1.0 | 20 | 2.1 | 1.0E+07 | 12 | 0.73 | 6521.8 | Below measurement lower limit | 1.29 | 1.26 | 1 |
| Example 35 | 1.0 | 20 | 2.1 | 1.0E+11 | 12 | 0.73 | 8797.1 | 2.2 | 1.30 | 1.27 | 1 |
| Example 36 | 1.0 | 20 | 2.1 | 1.0E+12 | 12 | 0.73 | 534 | 6.3 | 1.28 | 1.17 | 2 |
| Example 37 | 1.0 | 20 | 2.1 | 1.0E+07 | 3 | 0.70 | 10445.1 | Below measurement lower limit | 1.28 | 1.24 | 1 |
| Example 38 | 1.0 | 20 | 2.1 | 1.0E+07 | 7 | 0.71 | 8907 | Below measurement lower limit | 1.31 | 1.28 | 1 |
| Example 39 | 1.0 | 20 | 2.1 | 1.0E+07 | 20 | 0.75 | 10199 | Below measurement lower limit | 1.28 | 1.25 | 1 |
| Example 40 | 1.0 | 20 | 2.1 | 1.0E+07 | 30 | 0.76 | 7457 | Below measurement lower limit | 1.30 | 1.26 | 1 |
| Example 41 | 1.0 | 20 | 2.1 | 1.0E+07 | 12 | 0.50 | 382 | Below measurement lower limit | 1.31 | 1.20 | 2 |
| Example 42 | 1.0 | 20 | 2.1 | 1.0E+07 | 3 | 0.55 | 307 | Below measurement lower limit | 1.31 | 1.21 | 2 |
| Example 43 | 1.0 | 20 | 2.1 | 1.0E+07 | 7 | 0.51 | 376.9 | Below measurement lower limit | 1.28 | 1.17 | 2 |
| Example 44 | 1.0 | 20 | 2.1 | 1.0E+07 | 20 | 0.49 | 589.5 | Below measurement lower limit | 1.31 | 1.21 | 2 |
| Example 45 | 1.0 | 20 | 2.1 | 1.0E+07 | 30 | 0.47 | 407.6 | Below measurement lower limit | 1.28 | 1.18 | 2 |
| Example 46 | 1.0 | 20 | 2.1 | 1.0E+07 | 12 | 0.91 | 9465.2 | Below measurement lower limit | 1.30 | 1.27 | 1 |
| Example 47 | 1.0 | 20 | 2.1 | 1.0E+07 | 3 | 0.95 | 8293.5 | Below measurement lower limit | 1.29 | 1.25 | 1 |
| Example 48 | 1.0 | 20 | 2.1 | 1.0E+07 | 7 | 0.92 | 11876.4 | Below measurement lower limit | 1.31 | 1.27 | 1 |
| Example 49 | 1.0 | 20 | 2.1 | 1.0E+07 | 20 | 0.90 | 6514.7 | Below measurement lower limit | 1.30 | 1.26 | 1 |
| Example 50 | 1.0 | 20 | 2.1 | 1.0E+07 | 30 | 0.89 | 8779.4 | Below measurement lower limit | 1.30 | 1.26 | 1 |

Electrophotographic members of the present constitution having an elastic layer whose elastic modulus is 0.5 MPa or more to 3.0 MPa or less and a coating layer whose elastic modulus is 5.0 MPa or more to 100.0 MPa or less have a small image density difference between before and after an endurance test and are therefore considerably useful as an electrophotographic member.

As shown above in Table 19, even when correlation with the second protrusion is changed by changing the film thickness or resistivity of the coating layer or roughening particles to be added, the present constitution is also effective.

Examples 51 to 70

Evaluation results of Examples 51 to 70 are collectively shown in Table 20.

TABLE 20

| Example | Elastic modulus of elastic layer Mpa | Elastic modulus of coating layer Mpa | Elastic modulus of insulating part GPa | Resistivity of insulating part Ω · cm | Covering ratio of insulating part % | Time constant First region (sec) | Time constant Second region (sec) | Image density Before endurance | Image density After endurance | Evaluation Rank |
|---|---|---|---|---|---|---|---|---|---|---|
| Example 1 | 1.0 | 20 | 2.1 | 1.0E+15 | 40 | 6521.8 | Below measurement lower limit | 1.29 | 1.26 | 1 |
| Example 51 | 1.0 | 20 | 2.1 | 1.0E+13 | 40 | 11000.4 | Below measurement lower limit | 1.29 | 1.25 | 1 |
| Example 52 | 1.0 | 20 | 2.1 | 1.0E+17 | 40 | 9259.2 | Below measurement lower limit | 1.29 | 1.25 | 1 |
| Example 53 | 1.0 | 20 | 2.1 | 1.0E+12 | 40 | 65.2 | Below measurement lower limit | 1.29 | 1.04 | 3 |
| Example 54 | 1.0 | 20 | 2.1 | 1.0E+13 | 40 | 8743 | Below measurement lower limit | 1.30 | 1.26 | 1 |
| Example 55 | 1.0 | 20 | 2.1 | 1.0E+17 | 40 | 6205.6 | Below measurement lower limit | 1.29 | 1.25 | 1 |
| Example 56 | 1.0 | 20 | 2.1 | 1.0E+12 | 40 | 65.1 | Below measurement lower limit | 1.28 | 1.03 | 3 |
| Example 57 | 1.0 | 20 | 2.1 | 1.0E+13 | 40 | 7352.9 | 2.1 | 1.29 | 1.25 | 1 |

TABLE 20-continued

| Example | Elastic modulus of elastic layer Mpa | Elastic modulus of coating layer Mpa | Elastic modulus of insulating part GPa | Resistivity of insulating part Ω · cm | Covering ratio of insulating part % | Time constant First region (sec) | Time constant Second region (sec) | Image density Before endurance | Image density After endurance | Evaluation Rank |
|---|---|---|---|---|---|---|---|---|---|---|
| Example 58 | 1.0 | 20 | 2.1 | 1.0E+17 | 40 | 6627 | 2.4 | 1.28 | 1.25 | 1 |
| Example 59 | 1.0 | 20 | 2.1 | 1.0E+12 | 40 | 77.6 | 2.8 | 1.29 | 1.03 | 3 |
| Example 60 | 1.0 | 20 | 2.1 | 1.0E+13 | 40 | 10734.4 | 6.1 | 1.30 | 1.26 | 1 |
| Example 61 | 1.0 | 20 | 2.1 | 1.0E+17 | 40 | 11194.6 | 6.5 | 1.30 | 1.27 | 1 |
| Example 62 | 1.0 | 20 | 2.1 | 1.0E+12 | 40 | 81 | 7.1 | 1.30 | 1.04 | 3 |
| Example 63 | 1.0 | 20 | 2.1 | 1.0E+15 | 10 | 11048.7 | Below measurement lower limit | 1.30 | 1.27 | 1 |
| Example 64 | 1.0 | 20 | 2.1 | 1.0E+15 | 80 | 6604.6 | Below measurement lower limit | 1.29 | 1.25 | 1 |
| Example 65 | 1.0 | 20 | 2.1 | 1.0E+15 | 5 | 568.6 | Below measurement lower limit | 1.31 | 1.21 | 2 |
| Example 66 | 1.0 | 20 | 2.1 | 1.0E+15 | 95 | 588.9 | Below measurement lower limit | 1.28 | 1.17 | 2 |
| Example 67 | 1.0 | 20 | 2.1 | 1.0E+15 | 10 | 6760.6 | Below measurement lower limit | 1.30 | 1.27 | 1 |
| Example 68 | 1.0 | 20 | 2.1 | 1.0E+15 | 80 | 6999 | Below measurement lower limit | 1.29 | 1.26 | 1 |
| Example 69 | 1.0 | 20 | 2.1 | 1.0E+15 | 5 | 401.9 | Below measurement lower limit | 1.30 | 1.20 | 2 |
| Example 70 | 1.0 | 20 | 2.1 | 1.0E+15 | 95 | 468.6 | Below measurement lower limit | 1.30 | 1.20 | 2 |

Electrophotographic members of the present constitution having an elastic layer whose elastic modulus is 0.5 MPa or more to 3.0 MPa or less and a coating layer whose elastic modulus is 5.0 MPa or more to 100.0 MPa or less have a small image density difference between before and after an endurance test and are considerably useful as an electrophotographic member.

As shown above in Table 20, even when the test is performed by changing the volume resistivity or covering ratio of the insulating part, the above-described constitution is also effective.

Examples 71 to 76 and Comparative Examples 29 and 30

Evaluation results of Examples 71 to 76 and Comparative Examples 29 and 30 are collectively shown in Table 21.

TABLE 21

| Example | Elastic modulus of elastic layer Mpa | Elastic modulus of coating layer Mpa | Elastic modulus of insulating part Gpa | Elastic modulus of insulating region of surface layer Gpa | Elastic modulus of conductive region of surface layer Gpa | Time constant First region (sec) | Time constant Second region (sec) | Image density Before endurance | Image density After endurance | Evaluation Rank |
|---|---|---|---|---|---|---|---|---|---|---|
| Example 71 | 1 | 20 | — | 1.2 | 0.7 | 562.4 | Below measurement lower limit | 1.28 | 1.17 | 2 |
| Example 72 | 1 | 20 | — | 1.2 | 0.8 | 83.8 | Below measurement lower limit | 1.28 | 1.02 | 3 |
| Example 73 | 1 | 20 | — | 1.2 | 0.7 | 447.3 | Below measurement lower limit | 1.31 | 1.21 | 2 |
| Example 74 | 1 | 20 | — | 1.2 | 0.7 | 377.3 | Below measurement lower limit | 1.28 | 1.17 | 2 |
| Example 75 | 1 | 20 | — | 2.1 | 0.6 | 11979.5 | Below measurement lower limit | 1.3 | 1.27 | 1 |
| Example 76 | 1 | 30 | — | — | — | 77 | Below measurement lower limit | 1.28 | 1.03 | 3 |
| Comp. Ex. 29 | 1 | 20 | — | — | — | — | Below measurement lower limit | 0.82 | — | — |
| Comp. Ex. 30 | 1 | 20 | 2.1 | — | — | 70.2 | Below measurement lower limit | 1.31 | 0.8 | 4 |

In Examples 71 to 76, the electrophotographic member was manufactured by changing a method of forming an insulating first region on the outer surface side of the coating layer. The electrophotographic member of the present constitution having an elastic layer whose elastic modulus is 0.5 MPa or more to 3.0 MPa or less and a coating layer whose elastic modulus is 5.0 MPa or more to 100.0 MPa or less has a small image density difference between before and after an endurance test and is considerably useful as an electrophotographic member.

On the other hand, the electrophotographic member of Comparative Example 29 did not have an insulating first region on the outer surface side of the coating layer so that it had a small time constant from the initial stage, was inferior in toner conveyance and had a small image density.

Although the electrophotographic member of Comparative Example 30 had a constitution similar to that of Example 1 except that it had no first protrusion, its image density difference between before and after an endurance test is very large.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-144361, filed Jul. 31, 2018, which is hereby incorporated by reference herein in its entirety.

What is claimed is:

1. An electrophotographic member comprising an electro-conductive substrate, an elastic layer on the substrate and a coating layer on the elastic layer, wherein the elastic layer has a first protrusion on a surface thereof on a side opposite to a side facing the substrate, the electrophotographic member has, on an outer surface thereof, a second protrusion derived from the first protrusion, the outer surface of the electrophotographic member has one or more of electrical insulating first region(s) and an electro-conductive second region, the elastic layer has an elastic modulus, as measured in an environment of a temperature of 30° C. and a relative humidity of 80%, of 0.5 MPa or more to 3.0 MPa or less and the coating layer has an elastic modulus, as measured in an environment of a temperature of 30° C. and a relative humidity of 80%, of 5.0 MPa or more to 100.0 MPa or less.

2. The electrophotographic member according to claim 1, wherein the first region has an electrical insulating part on a surface of the coating layer on a side opposite to a side facing the substrate.

3. The electrophotographic member according to claim 2, wherein the electrical insulating part contains a resin.

4. The electrophotographic member according to claim 2, wherein the electrical insulating part has an elastic modulus larger than the elastic modulus of the coating layer.

5. The electrophotographic member according to claim 1, wherein the coating layer is an electro-conductive and the second region has a portion of a surface of the coating layer on a side opposite to a side facing the substrate.

6. The electrophotographic member according to claim 5, wherein the coating layer has a volume resistivity of from $1\times10^{5}$ to $1\times10^{11}$ Ω·cm.

7. The electrophotographic member according to claim 2, wherein the electrical insulating part has a volume resistivity of from $1\times10^{13}$ to $1\times10^{18}$ Ω·cm.

8. The electrophotographic member according to claim 1, further comprising an electro-conductive surface layer on a surface of the coating layer on a side opposite to a side facing the substrate, wherein:

the surface layer comprises, on a surface thereof on a side opposite to a side facing the coating layer, an electrical insulating region and an electro-conductive region, the electrical insulating region constitutes the first region and the electro-conductive region constitutes the second region.

9. The electrophotographic member according to claim 8, wherein the electrical insulating region has an elastic modulus larger than the elastic modulus of the coating layer.

10. The electrophotographic member according to claim 8, wherein the surface layer has an electrical insulating part constituting the first region and an electro-conductive part constituting the second region.

11. The electrophotographic member according to claim 10, wherein the electrical insulating part has a volume resistivity of from $1\times10^{13}$ to $1\times10^{18}$ Ω·cm.

12. The electrophotographic member according to claim 10, wherein the electro-conductive part has a volume resistivity of from $1\times10^{5}$ to $1\times10^{11}$ Ω·cm.

13. The electrophotographic member according to claim 1, wherein when a surface of the electrical insulating first region constituting the outer surface of the electrophotographic member is charged to a potential V0 (V), a potential damping time constant defined as a time required for damping the surface potential to V0×(1/e) is 60 seconds or more.

14. The electrophotographic member according to claim 1, wherein when a surface of the electro-conductive second region constituting the outer surface of the electrophotographic member is charged to a potential V0 (V), a potential damping time constant defined as a time required for damping the surface potential to V0×(1/e) is less than 6.0 seconds.

15. An electrophotographic process cartridge mounted detachably on an electrophotographic image forming apparatus, comprising at least a developing member, wherein the developing member has an electrophotographic member and wherein the electrophotographic member has an electro-conductive substrate, an elastic layer on the substrate and a coating layer on the elastic layer, wherein the elastic layer has a first protrusion on a surface thereof on a side opposite to a side facing the substrate, the electrophotographic member has, on an outer surface thereof, a second protrusion derived from the first protrusion, the outer surface of the electrophotographic member has one or more of electrical insulating first region(s) and an electro-conductive second region, the elastic layer has an elastic modulus, as measured in an environment of a temperature of 30° C. and a relative humidity of 80%, of 0.5 MPa or more to 3.0 MPa or less and the coating layer has an elastic modulus, as measured in an environment of a temperature of 30° C. and a relative humidity of 80%, of 5.0 MPa or more to 100.0 MPa or less.

16. An electrophotographic image forming apparatus, comprising at least a developing member, wherein the developing member has an electrophotographic member and wherein the electrophotographic member has an electro-conductive substrate, an elastic layer on the substrate and a coating layer on the elastic layer, wherein the elastic layer has a first protrusion on a surface thereof on a side opposite to a side facing the substrate, the electrophotographic member has, on an outer surface thereof, a second protrusion derived from the first protrusion, the outer surface of the electrophotographic member has one or more of electrical insulating first region(s) and an electro-conductive second region, the elastic layer has an elastic modulus, as measured in an environment of a temperature of 30° C. and a relative humidity of 80%, of 0.5 MPa or more to 3.0 MPa or less and the coating layer has an elastic modulus, as measured in an environment of a temperature of 30° C. and a relative humidity of 80%, of 5.0 MPa or more to 100.0 MPa or less.

* * * * *